United States Patent [19]

DeHaven et al.

[11] Patent Number: 4,727,790

[45] Date of Patent: Mar. 1, 1988

[54] AUTOMATED SHELL LOADING APPARATUS FOR EXTERNALLY MOUNTED TANK CANNON

[75] Inventors: Vernet F. DeHaven, Huron; Francis J. Warin, Oak Harbor, both of Ohio

[73] Assignee: Ares, Inc., Port Clinton, Ohio

[21] Appl. No.: 730,341

[22] Filed: May 3, 1985

[51] Int. Cl.[4] ..... F41F 9/04; F41F 9/06

[52] U.S. Cl. ..... 89/46; 89/47

[58] Field of Search ..... 89/45, 46, 47, 36.13; 364/423

[56] References Cited

U.S. PATENT DOCUMENTS

| | | | |
|---|---|---|---|
| 980,181 | 1/1911 | Asbury | 89/47 |
| 2,399,722 | 5/1946 | Cotter et al. | 89/47 |
| 2,988,962 | 1/1961 | Finn | 89/45 |
| 3,001,454 | 9/1961 | Carlberg et al. | 89/47 |
| 3,884,119 | 5/1977 | Zouck | 89/45 |
| 3,938,421 | 2/1976 | Novdmann | 89/47 |
| 4,038,906 | 8/1977 | Tidstrom | 89/47 |
| 4,313,363 | 2/1982 | Schreckenberg | 89/46 |
| 4,381,693 | 5/1983 | Dumez | 89/46 |

FOREIGN PATENT DOCUMENTS

| | | | |
|---|---|---|---|
| 0051119 | 12/1982 | European Pat. Off. | 89/33.1 |
| 2137101 | 3/1972 | Fed. Rep. of Germany | 89/46 |
| 2818279 | 8/1979 | Fed. Rep. of Germany | 89/45 |
| 660930 | 1/1928 | France | 89/46 |

*Primary Examiner*—Stephen C. Bentley

*Assistant Examiner*—Stephen M. Johnson

*Attorney, Agent, or Firm*—Allan R. Fowler

[57] ABSTRACT

Shell loading apparatus, particularly for an externally mounted tank cannon, provides automated loading of shells from a magazine in a vehicle to a cannon externally mounted to the vehicle. The shell loading apparatus includes a pair of opposed, generally D-shaped cam tracks mounted in a cannon pod rearwardly of the cannon breech. Linear portions of the cam tracks are parallel to the barrel bore axis, arcuate portions of the cam tracks are directed upwardly with straight lead-in segments thereof directed towards a magazine shell extraction position when the cannon barrel is in a specific elevational position for shell loading. A shell rammer is connected to cam followers disposed in the cam tracks. A rammer support is fixed to gun mounting structure parallel to the cam track lead in segment. Pressurized fluid actuators connected to the rammer move the rammer with cam followers constrained to the cam tracks from a first, shell extraction position to a second shell loading position, the cam tracks being configured for controlling upward and rearward and then forward movement from the first to the second positions. A deployable tripper mounted adjacent the second position causes the rammer to release the shell held thereby when the rammer is moved into the second position, the released shell being catapulted into the cannon breech. A sensor and control system control operation of the shell loading apparatus.

11 Claims, 17 Drawing Figures

AUTOMATED SHELL LOADING APPARATUS FOR EXTERNALLY MOUNTED TANK CANNON

BACKGROUND OF THE INVENTION

1. Field of the Invention

The present invention relates generally to the field of shell feeding and loading apparatus for guns, particularly, of automated shell feeding and loading apparatus for cannon.

2. Discussion of the Prior Art

Armored vehicles, in particular military tanks and mobile guns platforms, are widely considered, even in the nuclear age, to be the backbone of land-based military forces. As a result, there is a continual escalation in the development of improved and more survivable tanks and gun platforms on the one hand and in the development of improved and more potent anti-armor weapons on the other hand. In general, because of continual improvement in anti-armor weapons, modern tanks are constructed with more, and usually heavier, armor, which in turn usually results in the tanks being larger and more massive. This, in turn, generally requires larger and more powerful engines, transmissions and so forth, which require the tank to be still larger and more massive. In addition, because of tanks being more heavily armored, the tanks are required to mount larger, and more powerful cannon to combat heavily armed enemy tanks.

As tanks become heavier and larger they tend to become more mechanically complicated and very greatly more costly to purchase, operate and maintain. Moreover, weight and size limits are reached which make the tanks difficult or impossible to air transport, and existing roads, bridges and other structures may not be sufficiently strong to support the tank's weight.

Still further, the increased size of heavily armored tanks of current design results in a relatively large target profile which tends, in and of itself, to result in increased tank vulnerability to anti-armor weapons, thereby necessitating still more armor and still larger size. An additional consideration is that large tanks require relatively large tank crews and thus military manpower limitations alone may limit the number of large tanks that can be fielded.

As a result of such factors, it is considered by many that present main battle tanks are about as large and massive as is practical and may, nevertheless, be vulnerable to enemy anti-armor weapons. Thus, there is a current emphasis in many countries of the world to produce smaller tanks which, while still being heavily armored to protect the crew, have smaller target profiles and which preferably have reduced crew requirements.

A factor which has contributed to the large size and comparatively high profile of modern tanks is that the tank's cannon have typically been mounted within large, heavily armored turrets which also at least partially house a typicaly three man gun crew of gun commander, gun opreator and gun loader. Height is ordinarily provided in the tank for the gun loader to stand upright to enable loading shells from a shell magazine into the gun.

In order to reduce tank size and profile height, numerous new tank designs eliminate the conventional massive gun turret and, instead, mount the cannon exteriorally on top of a relatively small armored vehicle. Since, in such designs, the cannon is outside the crew compartment, automated loading of the cannon is needed for transferring shells from the vehicle upwardly into the cannon for firing. An important advantage associated with the provison of autoloading apparatus is that the previously-required gun loader is no longer required, thus reducing crew size. Furthermore, overall height of the tank can be reduced, in some instances by a significant amount, since head clearance for a standing shell loader crewman is no longer required and all crewmen in the tank can operate the vehicle and gun from a selected position.

The required autoloading apparatus for such externally mounted cannon are generally required to operate in a relatively restricted space and are typically required to move shells along a relatively complicated path from a magazine extraction position within the vehicle into the breech of the cannon. In addition, it is generally required that the autoloading apparatus operated in a reliable manner enabling comparatively rapid firing of the cannon. Furthermore, it is oridinarily required that the autoloading system have capability for selectively feeding more than one type of shell to the cannon according to the type of target under firing attack.

Such autoloader requirements are especially difficult to meet when, as is ordinarily the situation, the exteriorally mounted cannon with which the autoloading system is to be used is of a preexisting type configured for manual loading. The autoloader must then, in a very much more limited space, duplicate many of the shell loading motions of a human crewman, while at the same time usually having poor access to the cannon because of the manner in which the cannon is mounted outside the vehicle.

For these and other reasons, improvements in shell autoloading systems, particularly for exteriorally mounted cannon on tanks and the like, are needed to meet the requirements of next generation, low profile armored vehicles.

SUMMARY OF THE INVENTION

According to the present invention, automated shell loading apparatus for loading shells from a shell magazine into the breech of an associated gun for firing comprises a shell rammer having means for releasably gripping the base of a shell and means for moving the shell rammer between a first, shell extraction position in which, when the gun barrel is in a specific shell loading elevational position, the shell gripping means are positioned to grip the base of a shell located in a magazine shell pickup position and a second, shell releasing position in which the shell rammer is rearwardly aligned with the open breech of the associated gun and forward portions of a shell, the base of which is gripped by the gripping means, are inserted into the open breech. Included in the loading appratus are means responsive to forward movement of the shell rammer into the second position for causing the shell base gripping means to release the shell gripped thereby, whereupon forward momentum of the shell causes the shell to continue moving forwardly into the breech and to become fully chambered therein.

The means for moving the shell rammer causes initial movement of the rammer upwardly and rearwardly from the first position so as to extract from the magazine a shell tha base of which is gripped by the shell gripping means. Included is a generally "D"-shaped cam track having a linear portion and an arcuate portion, a cam track follower and means for interconnecting the cam track follower with the shell rammer. The cam track is mounted relative to the gun so that the cam track linear portion is substantially parallel to the gun barrel bore axis, the cam track arcuate portion being then directed upwardly in a direction generally orthogonal to the barrel bore axis. According to an embodiment, the means interconnecting the cam track follower with the shell rammer is configured for permitting limited linear movement of the rammer relative to the cam track follower. Correspondingly, the means for moving the rammer cause the rammer to move from the first position the limit of travel relative to the cam track follower permitted by the interconnecting means without any substantial movement of the cam track follower and thereafter cause movement of the cam track follower along the cam track.

Preferably, the gripping means are configured for automatically gripping the base of a shell located in the magazine pickup position when the rammer is moved to the first position and for automatically gripping the base of a shell when the rammer is at the second position and an unfired shell is ejected rearwardly from the breech to the rammer, the ejected shell being thereby enabled to be downloaded into the magazine by the shell loading apparatus when the barrel is in the shell loading elevational position.

To permit ejection of fired shell casings from the breech without interference by the shell loading apparatus, the means for moving the shell rammer are configured for causing, when the rammer is moved to the first position, regions rearwardly of the gun breech to be clear. Control means are preferably provided for enabling movement, by the rammer moving means, of the rammer to the first, shell extraction position only when the gun barrel is positioned at the loading position and the breech of the gun is open.

It is preferred that the rammer moving means include first and second cam tracks, means for mounting the two cam tracks rearwardly of the gun breech, in a laterally spaced apart relationship and associated first and second cam track followers connected to the rammer so as to enable limited linear movement between the rammer and the cam followers. The first and second cam tracks are substantially mirror images of one another and are symmetrically mounted, by their mounting means, about the barrel bore axis and to opposite sides thereof. Each of the cam tracks are generally "D"-shaped, each having a linear portion and an arcuate portion. The mounting means mounts the cam tracks so that the linear cam track portions are parallel to the barrel bore axis and the cam track arcuate portions are directed upwardly in a direction generally orthogonal to the barrel bore axis, the cam tracks being mounted to structure to which the gun is mounted and so that the cam tracks do not move when the gun barrel is elevated. The cam tracks are preferably formed having straight lead-in segments at forward end regions of the arcuate portions. The means for causing movement of the rammer preferably include a rammer support and guide mounted in fixed relationship relative to the cam tracks, a rammer cradle slidingly mounted to the rammer support and guide for linear movement towards and away from the lead-in segments of the cam track arcuate portions, and a rammer frame pivotally mounted to the rammer cradle, the rammer being slidably mounted within the rammer frame for limited sliding movement axially towards and away from the lead-in segments of the cam track arcuate portion when the cam followers are disposed in such lead-in segments.

Included in the means for causing movement of the rammer are a first fluid pressure actuating cylinder having one end pivotally connected to the rammer frame and the other end pivotally connected to structure to which the rammer support and guide is mounted. Initial extension of such cylinder causes movement of the rammer from the first position to the second position, thereby causing linear movement of the cam track followers along the lead-in segments of the cam track arcuate portions and causing linear movement of the rammer and the rammer cradle towards the cam tracks. Further included in the rammer moving means is a second fluid pressure actuating cylinder connected between the rammer frame and the cam followers for causing linear sliding movement of the cam followers relative to the rammer frame. Combined operation of the first and second pressurized fluid cylinders then causes the cam followers to move rearardly along the cam track arcuate portions and then back fowardly along the cam track linear portions, thereby causing continued movement of the rammer to the second position.

In an embodiment, the gun is mounted to a vehicle, the gun barrel being substantially horizontal when in the specific, shell loading elevational position and when the vehicle to which the gun is mounted is on a substantially horizontal surface.

It is preferred that the shell loading apparatus include releasing means for selectively causing the shell gripping means to release the base of a shell when the rammer is in the first shell pickup position so as to enable the downloading return of a shell to the magazine from the breech. The shell gripping means preferably comprise a pair of shell base gripping jaws. The downloading releasing means include means preferably a pressurized fluid operated plunger which engages actuating portions of the shell base gripping jaws for causing the opening of the shell base gripping jaws.

In an embodiment, the means for causing movement of the rammer between the first, shell pickup position and the second, shell discharging position include means for moving the shell rammer to a third, static position located intermediate the first and second positions and relatively adjacent to the first position. In the static position, the gripping means of the rammer are out of engagement with a shell in the magazine shell pickup position, so as to enable movement of shells into and out of the pickup position without interference by the rammer. Accordingly, the means for causing movement of the rammer between the first and second positions is operative, when the rammer is stopped in the third, static position for first moving the rammer from the third position to the first position for gripping a shell in the magazine shell pickup position for the extraction therefrom, the rammer being then moved from the first position, back through the third position, to the second, shell loading position.

The means for causing release of a shell held in the rammer by the shell gripping means when the rammer is moved to the second, shell discharging position may include actuating means operatively connected to the shell gripping means and mounted to the shell rammer, and tripping means fixed to structure to which the gun is mounted. Included may be deploying means operatively connected to the tripping means for selectively causing the tripping means to pivot between a first, deployed position in which the tripping means is engaged by the actuating means so as to cause releasing of the shell gripping means when the rammer is moved forwardly into the second position for loading a shell into the gun breech and a second, retracted position in which the tripping means is out of the way of shells and shell casings being ejected rearwardly from said gun breech. Preferably, the tripping means include a pivotally mounted tripper and a pressurized fluid actuated piston connected thereto.

BRIEF DESCRIPTION OF THE DRAWINGS

A better understanding of the present invention may be had from a consideration of the following detailed description, taken in conjunction with the accompanying drawings in which:

FIG. 9(*a*) shows the rammer in the third, static position;

FIG. 9(*b*) shows a rammer head of the apparatus moved forwardly and downwardly to the first shell pickup position in which gripping portions of the rammer engage a shell held in an associated magazine;

FIG. 9(*c*) shows portions of the rammer assembly being moved upwardly and rearwardly to extract a shell from the magazine;

FIG. 9(*d*) shows continued upward and rearward movement of portions of the rammer assembly and movement of cam follower portions of the rammer assembly along cam track portions of the apparatus;

FIG. 9(*e*) shows initial tilting of the rammer head and the shell held thereto;

FIG. 9(*f*) shows continued tiliting of the rammer head and the shell held thereto with the cam follower moved further along the cam track;

FIG. 9(*g*) shows the rammer head at maximum tilt with the shell held thereto rearwardly aligned with barrel breech and the rammer head starting its forward movement; and FIG. 9(*h*) shows the rammer head moved forwardly into the second, shell loading position and shows the released shell fully chambered in the barrel breech.

DESCRIPTION OF THE PREFERRED EMBODIMENT

Figure 1:
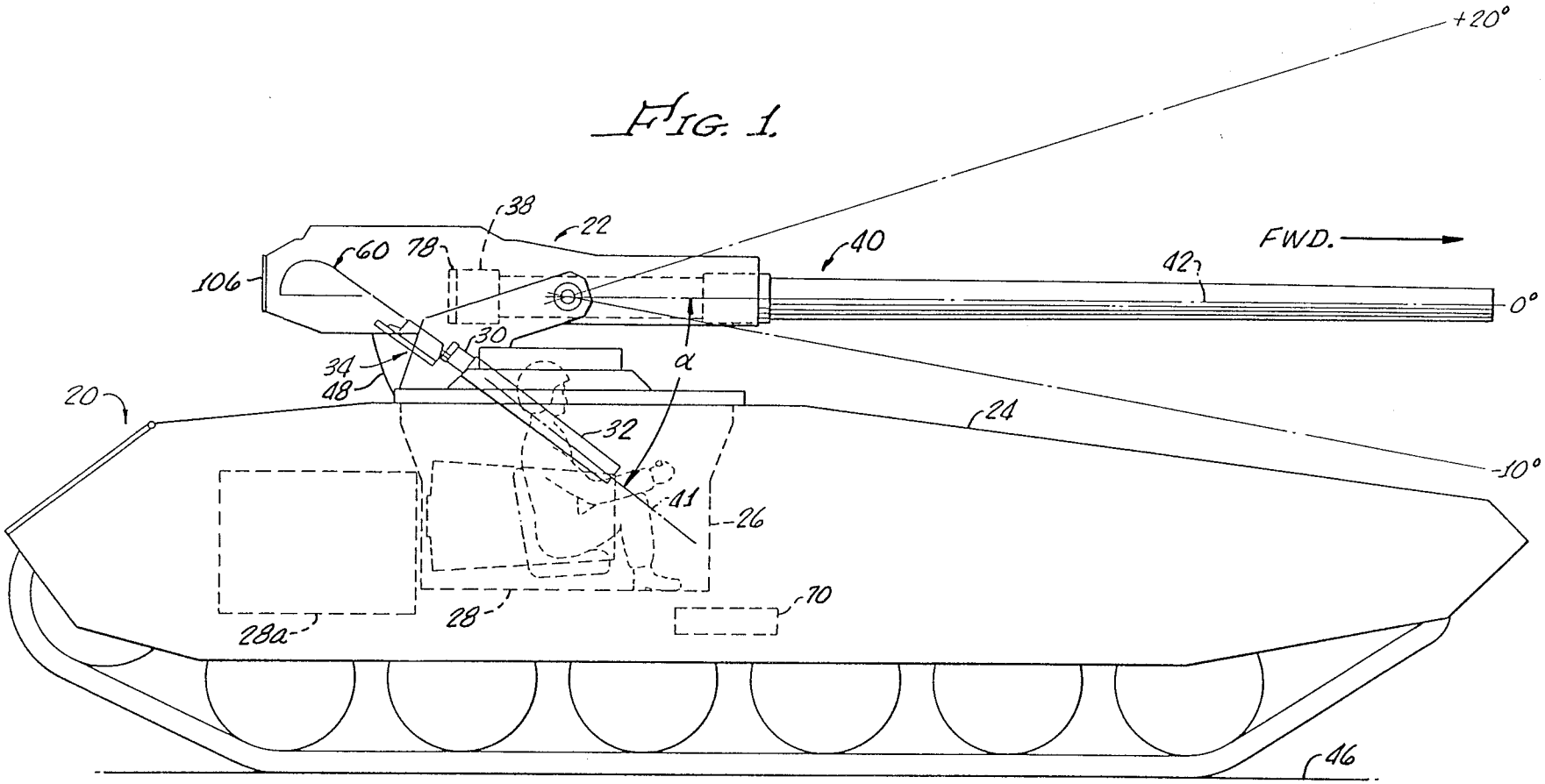
FIG. 1 is a side elevational view of an exemplary. military tank having an externally mounted cannon with which the automated shell loading apparatus of the present invention may be used to advantage.

A better understanding of the present invention may be had from the examination of FIG. 1 which depicts an exemplary military tank, mobile armored gun platform or the like 20 for which the present invention is especially adapted. Comprising tank 20 is an external gun pod 22 and an armored vehicle 24, the vehicle having almost fully recessed therein a gun crew basket 26 which is mounted in the vehicle for azimuthal rotational movement, preferably through a full 360 degrees. Gun pod 22 is mounted to basket 26 for azimuthal rotation therewith and is mounted so as to enable limited elevational pivoting, for example, from about −10 degrees to about +20 degrees of elevation. Installed in basket 26 is a shell magazine 28 in which a number of shells 30 of conventional tapered shape are held. Other shell storage means 28*a* may be provided in vehicle 24 from which magazine 28 may, from time to time, be resupplied with shells 30. Magazine 28 has a particular shell loading or pickup position 32 to which shells are sequentially moved by magazine operating means (not shown). By way of specific example, with no limitations thereby intended or implied, magazine 28 may be as described in our copending application Ser. No. 730,772, filed on May 3, 1985. However, virtually any type of magazine may be employed which has capability of moving shells 30 to pickup position 32.

An automated shell loading apparatus, or "autoloader" 34, according to the present invention, is provided for extracting shells 30 from magazine pickup position 32 and for then transporting the extracted shells rearwardly and upwardly from the pickup position into rearward, housing portions 36 of gun pod 22, and then forwardly into a breech 38 of a cannon 40 mounted in forward regions of the gun pod.

Since magazine 28, which provides an immediately available supply of shells 30 for cannon 40 is disposed within basket 26, the magazine necessarily rotates in azimuth with gun pod 22 and the cannon. Magazine shell pickup position 32 is, as a consequence, azimuthally fixed with respect to cannon 40, a longitudinal axis 41 of a shell 30 in the pickup position and a bore axis 42 of the cannon barrel 44 always being in a common plane which is vertical when tank 20 is on a horizontal surface 46. However, as gun pod 22, with cannon 40, pivots in elevation, the elevational position, represented by the angle "$\alpha$," between magazine shell pickup position axis 41 and barrel bore axis 42 changes, even though both such axes always remain in the same plane.

As described below, shell loading apparatus 34 is fixed to mounting structure 48 of gun pod 22 so that the loading apparatus remains, for all azimuthal and elevational movement of the gun pod, fixed raltive to the gun pod. It can, however, be appreciated that if shell loading apparatus 34 were required to pickup or extract sheels 30 from magazine 28 at any barrel elevation angle, the shell loading apparatus would have to be much more complicated, and hence much more costly and possible inherently less reliable, that if the shell loading apparatus were required to extract shells from magazine shell pickup position 32 at only one particular barrel elevational angle. It has, therefore, been established as an operating condition for apparatus 34 of the present invention that gun pod 22 be elevationally pivoted to a position in which barrel bore axis 42 is parallel to surface 46 on which tank 20 is standing or moving. That is, when tank 20 is on a horizontal surface 46, barrel bore axis 42 is required to be horizontal before shell loading apparatus 34 is operated to extract a shell 30 from magazine shell pickup position 32. Accordingly, between firings, gun pod 22 is required to be pivoted to such zero elevational position (FIG. 1) for reloading. Although any other specific elevational position could alternatively be selected for reloading, the zero elevational position has been selected as a believed optimum position, and is shown and described herein for illustrative purposes. It is, however, to be understood to operate at other specific gun elevational angles and the present invention is not limited to operation at any particular gun elevational angle, even though the apparatus is constrained to operate at only one (selected) elevational angle.

Figure 2:
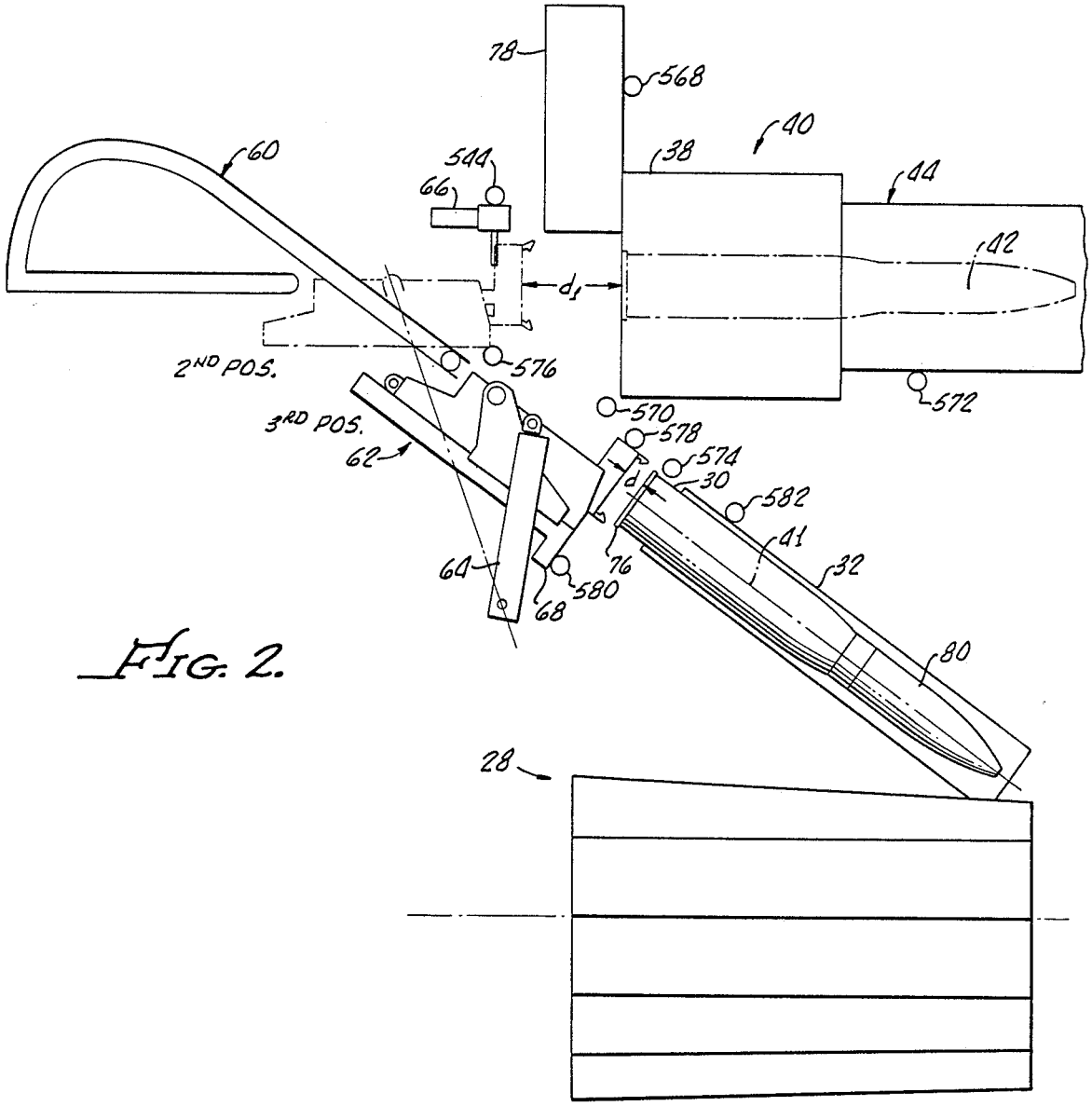
FIG. 2 is a pictorial diagram of the automated shell loading apparatus of the present invention showing major components thereof.

Generally comprising shell loading apparatus 34, as depicted in FIG. 2, are cam track means 60, shell rammer means 62, rammer actuating means 64, shell loading release tripper means 66 and shell downloading release tripper means 68. Also comprising part of apparatus 34 are electronic sensing and control means 70 (FIG. 3), which control operational sequencing of shell rammer means, 62, for example, providing for operation thereof only when gun pod 22 is at the selected elevational loading position (zero position).

In general, and as more particularly described below, apparatus 34 is configured and operated so that when gun pod 22 is in the loading position (zero position) portions of shell rammer means 62 are moved forwardly and downwardly a short distance, d, from a static position to a first, shell extracting position, in which such portions of the ramming means latch onto a base or rim portion 76 of a shell 30 in magazine shell pickup position 32. Then portions of the rammer means are moved upwardly and rearwardly in a linear direction enabling extraction of the picked-up shell 30 from magazine 28, some portions of the ramming means moving along cam track means 60 which control movement of the ramming means 62. As the portions of ramming means 62 that engage cam track means 60 continue moving therealong, other portions of the ramming means and the shell 30 just extracted thereby from magazine 28 are pivoted upwardly into alignment with barrel bore axis 42. Thereafter, portions of ramming means 62 are moved forwardly, still controlled by cam track means 60, towards a second, shell loading position. At such position, forwardly moving portions of the rammer means 62 engage shell loading release tripper means 66, which cause unlatching of shell 30 being transported by the rammer means, and then stop. Second rammer means position is located a sufficient distance, $d_1$, rearwardly of breech 38 (for example, about nine inches for a 105 mm cannon) to produce clearance for a vertically sliding breech block 78 which is operative for closing the breech during shell firing. However, at the second rammer means position, nose or projectile portions 80 of shell 30 carried by rammer means 62 will already have been inserted into breech 38, forward momentum of the shell when the shell is released by tripper means 66 causing the shell to fully insert itself in the breech.

After a shell 30 carried by rammer means 62 is loaded in the above-described manner into breech 38, the rammer means are moved in a reverse direction back either to the static position, if cannon 40 is not fired or is not to be immediately reloaded, or to the first position to pick up a next shell 30 from the magazine shell pickup position 32, provided the cannon is fired and is to be immediately reloaded.

In the event a shell 30 has been loaded into breech 38 in the above described manner and a decision is made not to fire cannon 40, the loaded shell may also be downloaded back into magazine shell pickup position 32 by shell loading apparatus 34. For such purpose, portions of rammer means 62 are moved to the second, shell loading position without the deploying of tripper means 66. Breech block 78 is then slid upwardly to open breech 38, thereby also ejecting shell 30 rearwardly by conventioanl ejecting means (not shown). Shell 30 is ejected across distance, $d_1$, into automatic latching engagement with rammer means 62, after which reverse movement of the rammer means from the second position back to the firt rammer means position transports the shell rearwardly and then forwardly and downwardly back into magazine shell pickup position 32. When ramming means 62 are in the first position with the shell downloaded into magazine 28, downloading release tripping means 68 are actuated, causing the ramming means to release shell 30.

For shell downloading purposes, it may, depending on operational characeristics of cannon 40, be desirable or necessary to elevate the cannon before breech block 78 is opened so as to provide gravity assistance to the ejection of the unfired shell into latching engagement with rammer means 62. It is to be appreciated, however, that in such case cannon 40 must then be pivoted back to its zero, shell loading position before ramming means 62 are moved back to the first position so that the shell being downloaded into magazine 28 will be properly aligned with magazine shell pickup position 32.

After shell 30 is downloaded in the above-described manner, rammer means 62 are ordinarily moved upwardly and rearwardly the distance, d, back to the rammer means static position. The distance, d, between the rammer means static and first, shell pickup position is selected to provide clearance between rammer means 62 and all portions of magazine 28, including a shell 30 in pickup position 32, at all elevational positions of shell loading apparatus 34 and for any and all movement of the magazine and shells therein.

In general, the function of sensor and control means 70 are, as more particularly described below, to monitor the positions of various parts of shell loading apparatus 34 and of other selected parts of the overall weapons system, such as elevational position of gun barrel 44 and open/closed positions of breech block 78, and to cause operation of rammer actuating means 64 and tripper means 66 and 68 according to a preprogrammed, step-by-step routine dependent upon specific parts being in specified locations at specific points in time.

DETAILED DESCRIPTION

Figure 4:
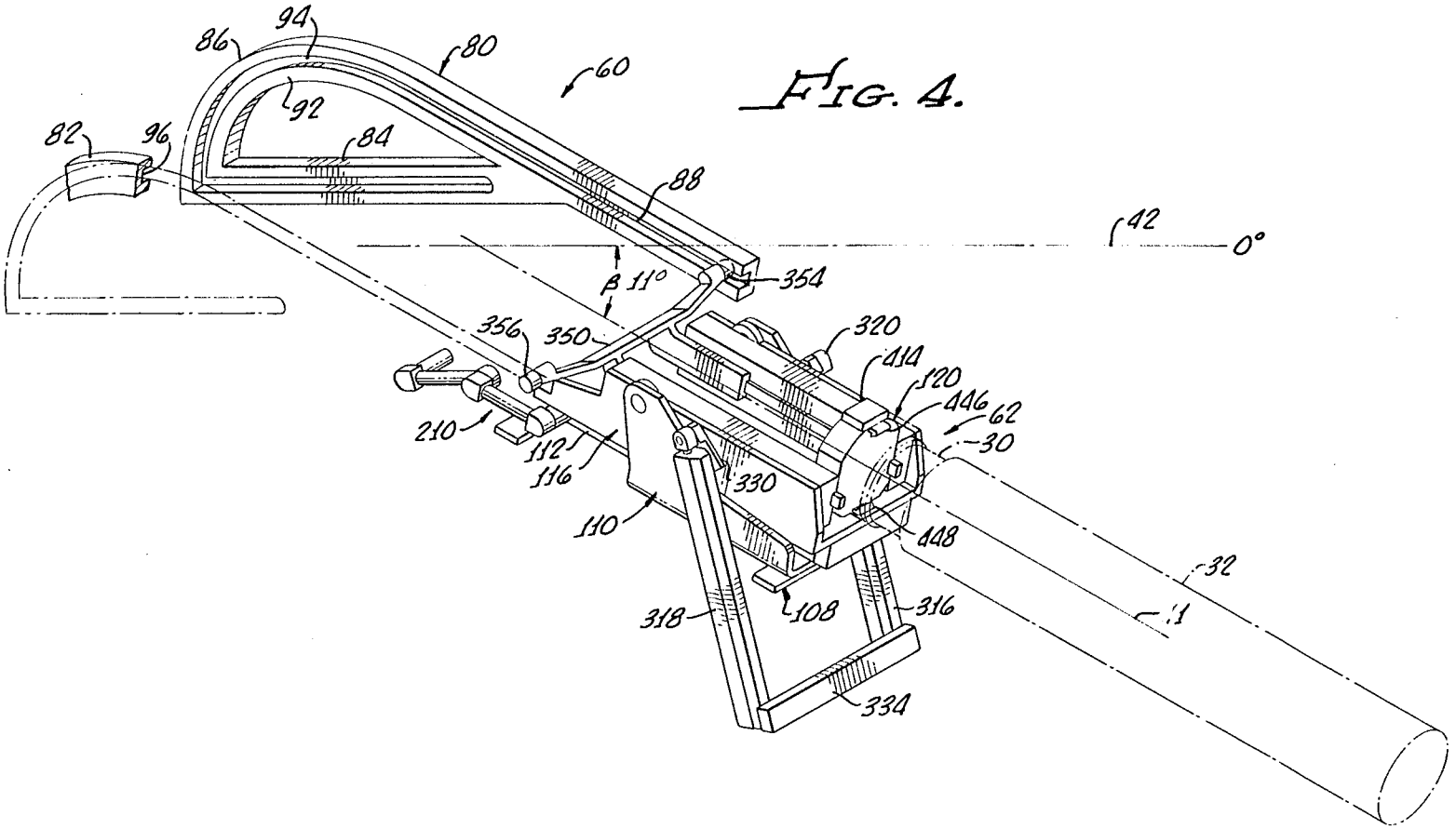
FIG. 4 is a perspective drawing showing cam track and rammer assembly portions of the automated shell loading apparatus.

Cam track means 60 comprise, as shown in FIG. 4, first and second, mirror image cam tracks 80 and 82, respectively, both of which are generally "D" shaped. As such, first cam track 80, by way of illustration, comprises a linear portion 84 and an arcuate portion 86. Arcuate portion 86 has a straight, tangential lead-in segment 88 which extends across the forward end of linear portion 84 so as to form an angle, "$\beta$," therebetween, the angle $\beta$ being equal to the angle between barrel bore axis 42 and longitudinal axis 41 through a shell 30 in shell pickup position 32 when the cannon 40 is in the loading elevational position (zero position). Formed into an inwardly facing surface 92 of first cam track 80 is a camming recess or groove 94 which follows the shape of the cam track. Second cam track 82 is constructed in the mirror image of first cam track 80 and has, therefore an inwardly-facing camming recess or groove 96, which is the mirror image of first cam track camming recess 94.

Cam tracks 80 and 82 are fixed, as with bolts 98 to structure 102 in gun pod rearward housing portion 36 rearwardly of breech 38, in a laterally spaced apart relationship. Each cam track 80 and 82 is mounted in housing portion 36 in a plane parallel to a plane through barrel bore axis 42 and axis 41 through pickup position 32, with one of the cam tracks to one side of the barrel bore axis and the other cam track to the other side of the bore axis, in a symmetrical manner. Moreover, cam tracks 80 and 82 are mounted so that linear portion 84 of first cam track 80 and the corresponding linear portion of second cam track 82 are parallel with barrel bore axis 42 and so that straight segment 88 of the first track and the corresponding straight segment of the second track are parallel to axis 41. Arcuate portion 86 of first track 80 and the corresponding arcuate portion of second track 82 are directed upwardly in a direction generally orthogonal to bore axis 42. Cam tracks 80 and 82 are transversely separated a distance, $d_2$, which is sufficient to permit unimpeded rearward ejection of fired shell casings from breech 38 between the cam tracks and outwardly through a hinged rear end flap 106 of housing portion 36 (FIG. 1).

Rammer means 62 (FIGS. 4, 5 and 6) comprise several nested parts which are slidingly or pivotally interconnected so as to provide sliding, pivoting and telescoping action during shell transporting between the above-described first and second positions. As such, rammer means 62 include a rammer support 108, a rammer cradle 110, a rammer actuating cylinder assembly 112, a rammer carrier assembly 114, a rammer frame 116, a rammer cam follower and slide assembly 118 and a rammer head assembly 120.

Rammer support 108 comprises (FIG. 5) a rigid rectangular support plate 130. An elongate cradle sliding guide 134, having an "I" shaped cross-section, is mounted at an upper surface 134 of plate 130 along a longitudinal axis 136 thereof and extends forwardly of a forward edge 138 of the plate. Rammer support 108 is bolted, by bolts 139, to structure 48 of tank 20 so that plate longitudinal axis 136 is parallel to, but offset below, axis 41 of pickup position 30, axis 136 being in the plane through axis 41 and barrel bore axis 42. Rammer support 108 is also fixed raltive to cam tracks 80 and 82, and axis 136 thereof is along a line midway between the two tracks. An aperture 140 is formed downwardly through guide 134 in forward regions thereof, on axis 136, to provide clearance for tripping portions of downloading tripper means 68, as described below.

Rammer cradle 110 is formed having a generally "C"-shaped cross-section with first and second sides 142 and 144, respectively, joined to side edges of a flat bottom portion 146. Formed along the longitudinal center of bottom portion 146 is a "T"-shaped slot 148, (open at the bottom) configured to slidingly engage upper portions 150 of rammer support guide 132 so as to enable the cradle to slide forwardly and rearwardly (Direction of arrows "A—A'") relative to rammer support 108. At least one cradle stop 152 depends from forward regions of a bottom surface 154 of bottom portion 146 adjacent slot 148. Stop 152 is configured for engaging a sidewardly projecting ear 156 formed on guide 132 at rearward regions thereof when cradle 110 reaches a preselected rearwardmost position relative to plate 130. First and second cradle sides 142 and 144 are angled rearwardly from a forward edge 158 of bottom portion 146, for example, at an angle of about 30 degrees. Formed rearwardly into bottom portion 146 from forward edge 158, along the longitudinal centerline of slot 148, is a "U"-shaped recess 161 which provides clearance for portions of rammer cylinder assembly 112 (as described below), when rammer cradle 110 is forwardly relative to rammer support 108. Apertures 160 and 162 are formed through upper rearward corner regions of respective first and second cradle sides 142 and 144, along a transverse axis 164. Rammer cradle bottom portion 146 is formed having a thickened region 166 in which slot 148 is formed. First and second recessed surfaces 168 and 170 between respective sides 142 and 144 and such thickened region 166 are thereby provided.

Comprising rammer cylinder assembly 112 are similar first and second, elongate pressurized fluid cylinders 182 and 184, respectively, which are arranged in a laterally spaced apart, parallel relationship. Projecting rearwardly from cylinders 182 and 184 are respective first and second pistons 186 and 188. Rigidly interconnecting forward ends of cylinders 182 and 184 is a transverse forward manifold 190, which is internally apertured so as to be in fluid communication with rearward ends of bores (not shown) in the cylinders for enabling pressurized fluid to be provided to both cylinder bores to drive pistons 186 and 188 rearwardly (direction of arrow "B"). Extending rearwardly from member 190 in a central region is a "U"-shaped boss 192 having an aperture 194 formed downwardly therethrough. Boss 192 is sized to fit within recess 160 of rammer cradle portion 166 when rammer cylinder assembly 112 is installed downwardly into cradle 110 with cylinders 182 and 184 resting along respective cradle recessed surfaces 168 and 170.

Rigidly interconnecting rearward end regions of cylinders 182 and 184 is a transverse, rearward manifold 196 which is internally apertured so as to be in fluid communication with rearward ends of bores (not shown) in the cylinders, for enabling pressurized fluid to be provided to both cylinder bores to drive pistons 186 and 188 forwardly (direction of arrow "B'").

Depending from rearward manifold 196, adjacent to first cylinder 182 is a rammer head drive chain connector 200, a similar chain connecter (not shown) depending from manifold 196 adjacent to second cylinder 184. Rearward ends of pistons 186 and 188 are formed having respective apertures 202 and 204 centered along a transverse axis 206 which moves in the directions of arros B—B' according to whether the pistons are extended rearwardly or retracted forwardly in cylinders 182 and 184.

Figure 5A:
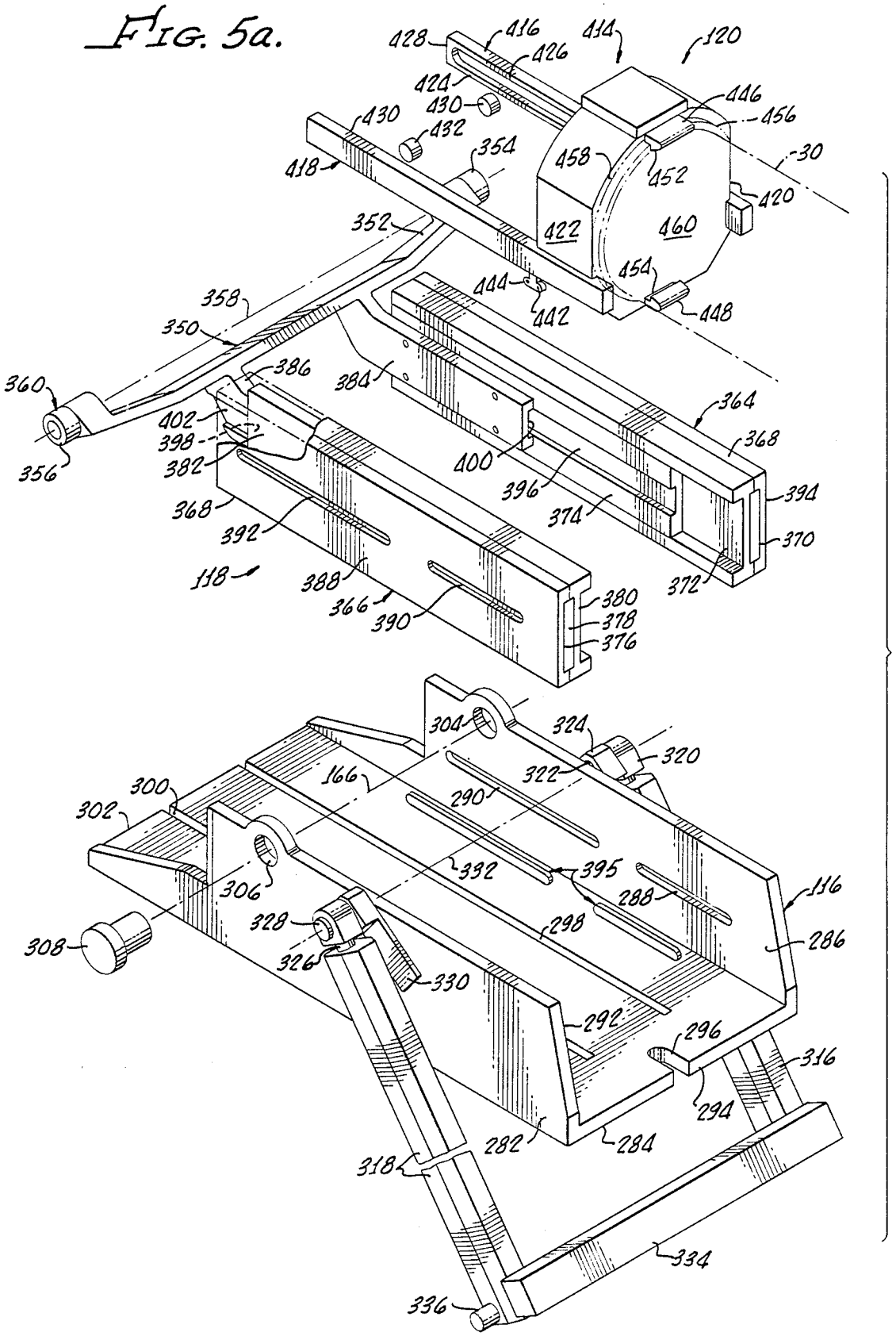
FIG. 5 is an exploded perspective drawing (on two sheets) showing components of the rammer assembly portions of the automated shell loading apparatus and showing interrelationships between such components, FIG. 5(*a*) being one on sheet and FIG. 5(*b*) being on a next sheet.
Figure 5B:
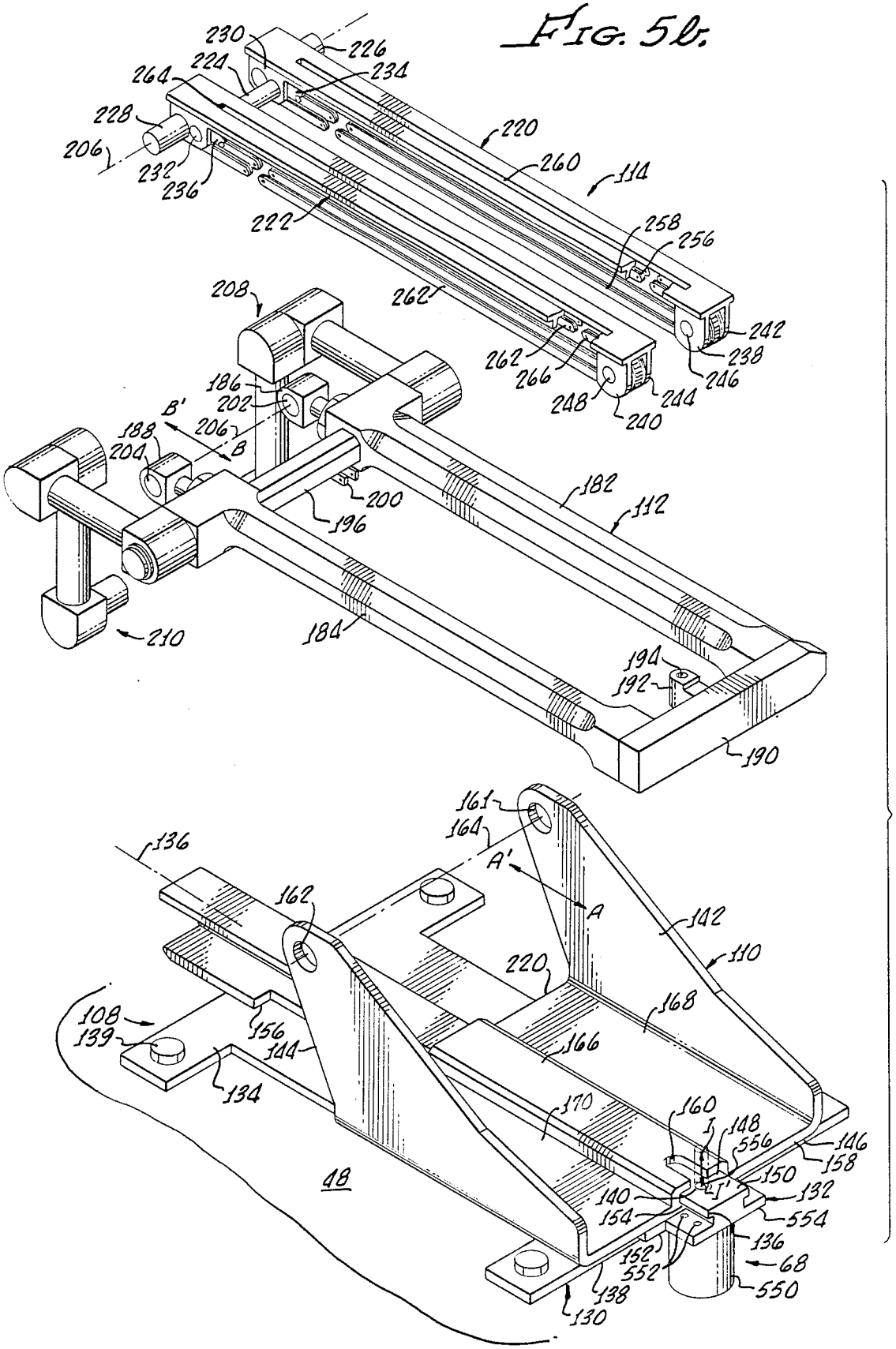

First and second articulated pressurized fluid supply (and return) conduits 208 and 210 are connected for providing pressurized fluid to forward and rearward manifolds 190 and 196, respectively. As shown in FIG. 5, first conduit 208 is connected to first cylinder 182 near the rearward end thereof and second conduit 210 is connected to second cylinder 184 near the rearward end thereof. However, first conduit 208 is connected to forward manifold 190 by means of a longitudinally extending passageway (not shown) formed in first cylinder 182 outwardly of the piston bore and which communicates with an internal passageway (not shown) in the forward manifold. Second conduit 210, in contrast, is connected by means of a transversely extending passageway (not shown) formed in second cylinder 184 around the piston bore and communicating with an internal passageway (not shown) in rearward manifold 198. Accordingly, pressurized fluid is provided to cylinders 182 and 184 from a suitable source (also not shown) through first conduit 208 to extend both pistons 186 and 188 rearwardly (direction of arrow B), in which case second conduit 210 functions as a fluid return line. Forward retraction of pistons 186 and 188 (direction of arros B') from extended positions is provided by supplying pressurized fluid to cylinders 182 and 184 through second conduit 210, first conduit 208 then functioning as a fluid return line.

Conduits 208 and 210 are articulated to accomodate forward and rearward movement of rammer cylinder assembly 112 with rammer cradle 110 (into which the rammer cylinder assembly is received) relative to rammer support 108. Movement (in the direction of arrows A—A') of rammer cylinder assembly 112 relative to cradle 110 in which the cylinder assembly is received is prevented by forward and rearward manifolds 190 and 196 which bear, respectively, against cradle forward edge 158 and a cradle rearward edge 220.

Pistons 186 and 188 are, as more particularly described below, interconnected with rammer head assembly 120 by carrier assembly 114. Comprising carrier assembly 114 are similar first and second, rigid longitudinal members 220 and 222, respectively, which are maintained in a laterally spaced apart, parallel relationship by a rearwardly located transverse member 224.

Sidewardly and outwardly projecting from a rearward end of first member 220 is a first pin 226. A similar, second pin 228 projects sidewardly and outwardly from the rearward end of a second member 222. Upon assembly of carrier assembly 114 with rammer cylinder assembly 112, a first pin 226 is installed outwardly through first piston aperture 202 and second pin 228 is installed outwardly through second piston aperture 204. As a consequence, extension and retraction of pistons 186 and 188, in direction of arrows B or B', causes corresponding movement of carrier members 220 and 222.

First carrier member 220 is formed having a depending semicircular portion 230 at a rearward end in the region of transverse member 224 connection. A similar, semicircular portion 232 is formed at a rearward end of second carrier member 222. Rotatably mounted on transverse member 224, in slots (not shown) formed in semicircular portions 230 and 232, respectively, are first and second, rearward sprockets 234 and 236. Forward ends of carrier members 220 and 222 are formed with similar, depending semicircular portions 238 and 240 which are split to receive respective first and second forward sprockets 242 and 244. Such forward sprockets 242 and 244 are rotatably mounted on respective transverse pivot pins 246 and 248.

Four segments of drive chain are provided for connecting carrier assembly 114 to rammer cylinder assembly 112 and to rammer head assembly 120. First chain segment 256 extends over first assembly sprocket 234. A lower forward end of such segment 256 attaches to chain attaching member 200 of cylinder assembly, as does a rearward end of a second chain segment 258. First chain segment 256 extends, after passing around first rearward sprocket 234, forwardly in a groove 260 longitudinally formed into upper regions of first member 220. Second chain segment 258 extends forwardly beneath first member 220, up and around first forward sprocket 242 and back rearwardly in groove 260 towards the forward end of first chain segment 256.

In a similar manner, a third chain segment 262 extends over second rearward sprocket 236, a lower forward end of such segment being attached (upon assembly) to the rammer cylinder assembly member (not shown) similar to member 200. Upper, forward portions of chain segment 262 extend forwardly in a groove 264 formed longitudinally along upper regions of second member 222. A fourth chain segment 266 passes around second forward sprocket 244, a lower rearward end of such chain segment being attached, with the lower forward end of third chain segment 262, to the second rammer cylinder bracket (not shown). After passing around second forward sprocket 244, fourth chain segment 266 extends rearwardly in groove 264 towards the upper forward end of third chain segment 262.

Upon assembly of rammer means 62, forward ends of first and third chain segments 256 and 262 and rearward ends of second and forth chain segments 258 and 266 are connected to rammer head assembly 120 (as described below). As a result of rammer head assembly 120 being interconnected through chain segments 256, 258, 262 and 266 to rammer cylinder assembly 112 in the manner described, "motion multiplication" is provided so that rammer head assembly 120 is moved rearwardly or forwardly twice the distance pistons 186 and 188 are moved rearwardly or forwardly.

Rammer frame 116 comprises a generally "C"-shaped channel having first and second vertical sides 280 and 282, respectively, at side edges of a flat bottom 284. Outside width of frame 116 is slightly less than inside width of cradle 110 so that the rammer frame can rest within the cradle on top of rammer cylinder assembly 112 and rammer carrier assembly 114. Formed into an inwardly facing surface 286 of first side 280 are respective forward and rearward longitudinal grooves 288 and 290, for mounting of rammer bridge and slide assembly 118, as described below. Similar longitudinal grooves (not shown) are formed into an inner surface 292 of second side 282.

Formed rearwardly into bottom 284 from a forward edge 294 thereof and along the longitudinal axis thereof is a "U"-shaped recess 296 for clearing, upon assembly of rammer means 62, boss 192 of rammer cylinder assembly 112. First and second laterally separated slots 298 and 300 are formed through bottom 284 from a rearward end 302 forwardly to enable ends of carrier chain segments 256, 258, 262 and 266 to extend upwardly through rammer frame 116 for connection to rammer head assembly 120 and to enable forward and rearward sliding movement of the rammer head assembly relative to the rammer frame.

Formed respectively through first and second rammer frame sides 280 and 282 are transversely aligned apertures 304 and 306. Such apertures 304 and 306 are, upon assembly of rammer means 62, aligned with apertures 161 and 162 of cradle 110. Bolts 308 passing through apertures 304 and 161 and through apertures 306 and 162 then pivotally mount rammer frame 116 to cradle 110. In this regard, length of cradle 110 rearwardly of apertures 162 and 162 is sufficiently short to enable upward pivoting of forward end regions of rammer frame 116 relative to the cradle when the frame is pivotally mounted to the cradle in the described manner. Length of rammer frame bottom 284 is such that the bottom extends substantially rearwardly of cradle 110 when rammer frame 166 is mounted to the cradle.

Pivotal movement of rammer frame 116 relative to rammer cradle 110 as well as forward and rearward movement thereof (as well as of rammer cylinder assembly 112, carrier assembly 114, rammer bridge and slide assembly 118 and rammer head assembly 120 along rammer support 108) is provide by first and second pressurized fluid cylinders 316 and 318. As shown in FIG. 5, a piston 320 of first cylinder 316 is pivotally connected, by a pivot pin 322, to an offset bracket 324 fixed to the outside of rammer frame first side forwardly of aperture 304, in a location forwardly adjacent of cradle side 142 when rammer frame 116 is pivotally connected to cradle 110. Similarly, a piston 326 of second cylinder 318 is pivotally connected, by a pivot pin 328, to an offset bracket 330 fixed to the outside of frame second side 282 in symmetry with first side bracket 324. Accordingly, both pivot pins 322 and 328 are on a common transverse pivot axis 332.

Lower regions of cylinders 316 and 318 are rigidly interconnected by transverse member 334 which assures that the cylinders at all times remain parallel with one another. Lower ends of cylinders 316 and 318 are pivotally mounted to gun pod mounting structure so as to remain fixed relative to cam tracks 80 and 82 and to rammer 108. A pivot pin 336 pivotally mounting the lower end of second cylinder 318 to such structure is shown in FIG. 5; a similar pivot pin (not shown) mounts the lower end of first cylinder 316 to such structure.

As further shown in FIG. 5(*b*), rearward regins of frame sides 280 and 282 are cutaway or stepped rearwardly of apertures 304 and 306 to provide clearance and reduce weight.

Rammer bridge and slide assembly 118 comprises, as shown in FIG. 5(*b*), a cam roller yoke or bridge 350 having a transverse arm 352 to opposite ends of which are rotatably mounted first and second cam follower rollers 354 and 356, respectively, the rollers being symmetrically mounted on a transverse axis 358. Lateral separation between rollers 354 and 356 is approximately equal to the separation distance, $d_2$, between cam tracks 80 and 82 so that the rollers are constrained to travel along cam track grooves 94 and 94 when rammer means 62 is assembled to cam track means 60. As shown, second roller 356 is mounted to yoke 350 by a pivot pin 360; first roller 354 is mounted to the yoke by a similar pivot pin, not shown.

Further comprising rammer bridge and slide assembly 118 are first and second, mirror image, telescoping side slide assemblies 364 and 366, respectively which are similar to telescoping drawer support slide assemblies used on may types of office file cabinet drawers. As such, first slide assembly includes a forward slide member 368, a forward-intermediate slide member 370, a rearward-intermediate slide member 372 and a rearward slide member 374. Correspondinly, second slide assembly comprises a forward slide member 376 a forward-intermediate slide member 378, a rearward-intermediate slide member 380 and a rearward slide member 382. Forward slide members 368 and 376 and rearward slide members 374 and 382 are generally "C"-channel shaped, whereas intermediate members 372 and 374, 378 and 380 are generally "I" beam shaped. As shown, forward intermediate slide members 370 and 378 slide within respective forward and rearward-intermediate slide members 368, 372 and 376, 380, being sandwiched therebetween.

Yoke 350 is formed having first and second, fowardly extending members 384 and 386, respectively, which are pinned or bolted to respective rearward slide members 374 and 382. Such rearward slide members 374 and 382 slide within respective rearward-intermediate slide members 372 and 380 and are sandwiched between such members and respective yoke members 384 and 386.

Stops (not shown) are provided on various of the slide members 368, 370, 374, 376, 378, 380 and/or 382, as is known in the art, to limit rearward extension movement of uoke 350 relative to forward slide members 368 and 376 and to retain the slide members relative to adjacent slide members.

Formed into an outer surface 388 of forward slide member 376 are forward and rearward, longitudinal grooves or recesses 390 and 392 which upon installation of rammer bridge and slide assembly 118 within rammer frame, mate with similar grooves (not shown) formed into inner surface 392 of rammer frame second side 282 (corresponding to groove 288 and 290 shown formed into first side inner surface 286).

Similar longitudinal recesses (not shown) are formed into an outer surface 394 of forward slide members and correspond to slots 288 and 290 on rammer frame side 280.

Elongate keys 395 installed into slide member slots 390 and 392 and corresponding rammer frame slots and into rammer frame slots 288 and 290 and corresponding slide member slots, lock forward slide members 368 and 376 to rammer frame 116 upon assembly of rammer means 62.

Formed into rearward slide members 374 and 382 are respective, inwardly facing, longitudinal recesses 396 and 398, respectively. Mating outwardly facing grooves 400 and 402 are formed in yoke member 384 and 386, respectively. Such grooves 396 and 398, 400 and 402 receive rail portions of rammer assembly 120, as described below.

Rammer assembly 120, as also shown in FIG. 5(*a*) comprises rammer head 414 and laterally spaced apart first and second, longitudinally extending rammer head rails 416 and 418, forward regions of which are fixed to respective sides 420 and 422 of the rammer head. Rail 416 is sized to slidingly fit into respective grooves 396 and 400. Formed into an inner surface 424 of first rail 416 is an elongate groove or recess 426 which extends forwardly from near a rearward end 428 of such rail to close to rammer head 414. A similar groove or recess (not shown) is formed into an inner surface 430 of second rail 418. Associated with groove 428 in rail 416 is a cylindrical stop 430; a similar, cylindrical stop 432 is associated with the corresponding groove in rail 418.

When rammer means 62 are assembled, rammer assembly 120 is interconnected with rammer bridge and slide assembly 118. Such interconnection is made by rammer head first rail 416 being received into grooves 396 and 400 in slide members 374 and 384 and by second rail 418 being received into grooves 398 and 402 of slide members 382 and 386. Upon such assembly, stop 430 is fixed into groove 400 and extends into rail groove 426, and stop 432 is fixed into groove 402 and extends into the groove (not shown) formed in second rail 418.

Forward and rearward relative movement of rammer assembly 120 relative to yoke 350 is limited by first rail groove 426 sliding along first stop 430 and by the second rail groove (not shown) sliding along second stop 432, length of the rail grooves establishing the amount of relative travel permitted between the rammer assembly and the yoke. In this regard, it is to be appreciated that stops 430 and 432 also cause forward or rearward movement of rammer assembly 120 (as caused by rammer cylinder assembly 112 and/or cylinders 316 and 318) to be transmitted to yoke 350, thereby also causing telescoping or extensions of slide assemblies 364 and 366 relative to rammer frame 116.

Depending from second rail 418, rearwardly adjacent to rammer head 414, are forward and rearward chain attaching brackets 442 and 444, respectively. Similar chain attaching brackets (not shown) depend from a corresponding region of first rail 416. Upon assembly of rammer means 62, with rammer assembly 120 interconnected in the above-described manner with yoke 350, chain attaching brackets 442 and 444 extend downwardly into slot 300 formed along bottom 284 of rammer frame 280. The upper, forward end of carrier assembly third chain segment 262 is pinned to rearward bracket chain attaching bracket 44 and the upper rearward end of fourth chain segment 266 is pinned to forward chain attaching bracket 442. In a similar manner, the forward and rearward chain attaching brackets (not shown) of first rail 416 extend downwardly into rammer frame slot 298, the upper, forward end of first chain segment 256 and the upper, rearward end of second chain segment 258 being respectively pinned to the rearward and forward chain attaching brackets.

As a result of such chain segment connection, rearward/forward movement of carrier assembly first and second members 220 and 222, caused by forward/rearward movement of pistons 186 and 188, causes forward-/rearward movement of rammer assembly 120, with the rammer assembly moving twice the distance of the pistons and carrier assembly members.

Mounted in rammer head 414 are shell gripping means 144 which comprise similar upper and lower shell base (rim) gripping jaws or members 446 and 448, respectively. Both gripping members 446 and 448 are spring loaded to a closed position (FIGS. 5(*a*) and 6) in which hook portions 452 and 454 of members 446 and 448, respectively, grip a projecting rim portion 456 of a shell 30 so as to hold a shell base surface 458 to a rammer head forward face 460.

Figure 6:
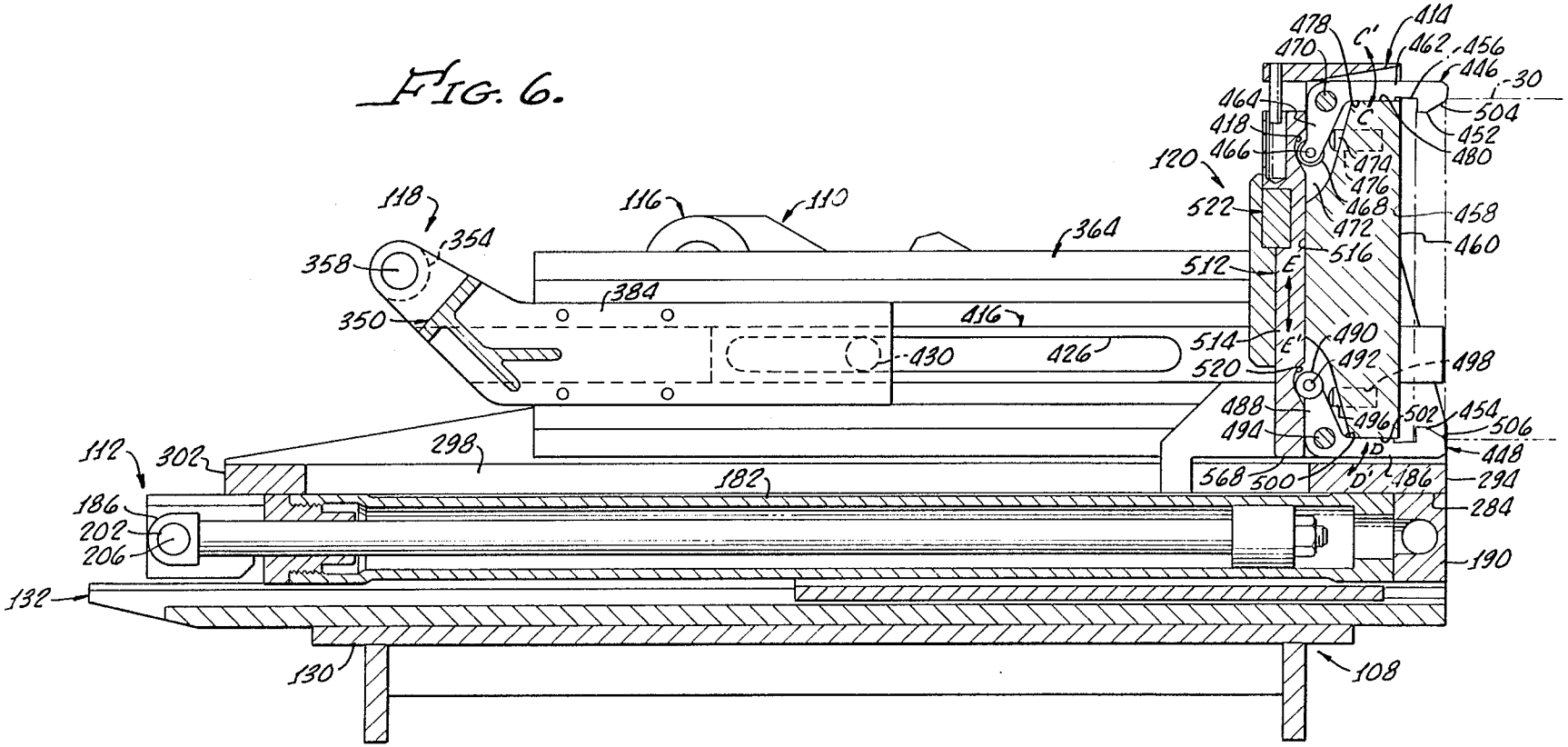
FIG. 6 is a vertical cross sectional view, taken along line 6—6 of FIG. 4, showing internal construction of a rammer head portion of the rammer assembly.

As shown in FIG. 6, upper gripping member 446 is generally "L"-shaped, having a forwardly projecting portion 462, of which hook portion 452 forms a forward end, and a downwardly projecting portion 464. Rotatably mounted to the lower end of portion 464, by a pin 466, is an actuating roller 468. Member 446 is pivotally mounted, in central regions, by a pivot pin 470, to rammer head 414 in a recess 472. A spring loaded pin 474 disposed in a rammer head cylindrical recess 476 forwardly of member lowre portion 464 pushes such portion rearwardly, thereby causing pivoting of the upper gripping member 446, about mounting pin 470 in the clockwise direction as seen in FIG. 6 (direction of arrow C).

In the shell rim gripping position shown in FIG. 6, a lower surface 478 of member forward portion 462 abuts an adjacent surface 480 of rammer head 414 which limits clockwise rotation of upper gripping member 446.

Lower gripping member 454 is similarly constructed, having a forwardly projecting portion 486 and an upwardly projecting portion 488. A roller 490 is rotatably mounted to the upper end of portion 488 by a pin 492, the lower member being pivotally mounted to rammer head 414 by a pin 494. A spring loaded pin 496, disposed in a rammer head recess 498, urges lower gripping member 448 in the counter clockwise direction (direction of Arrow D) until an upper surface 500 of forward portion 486 abuts an adjacent surface 502 of rammer head 414, the lower member then being in the shell rim gripping position shown.

Upper gripping member 446 has a forward facing ramping surface 504 and lower gripping member 448 has a forward facing ramping surface 506 which enable rim 456 of a shell 30 moving rearwardly with respect to the gripping members to pivot the gripping members open against pins 474 and 496. Upper gripping member 446 is thereby caused to pivot counterclockwise (direction of arrow C') and lower gripping member 448 is caused to pivot clockwsie (direction of arrow D') unitl shell rim 456 moves within hook regions 452 and 454, at which instant the gripping members snap closed to grip shell 30 by the rim. It can thus be appreciated that shell gripping members 446 and 448 operate in a manner similar to conventional shell ejectors on many types of guns.

Figure 7:
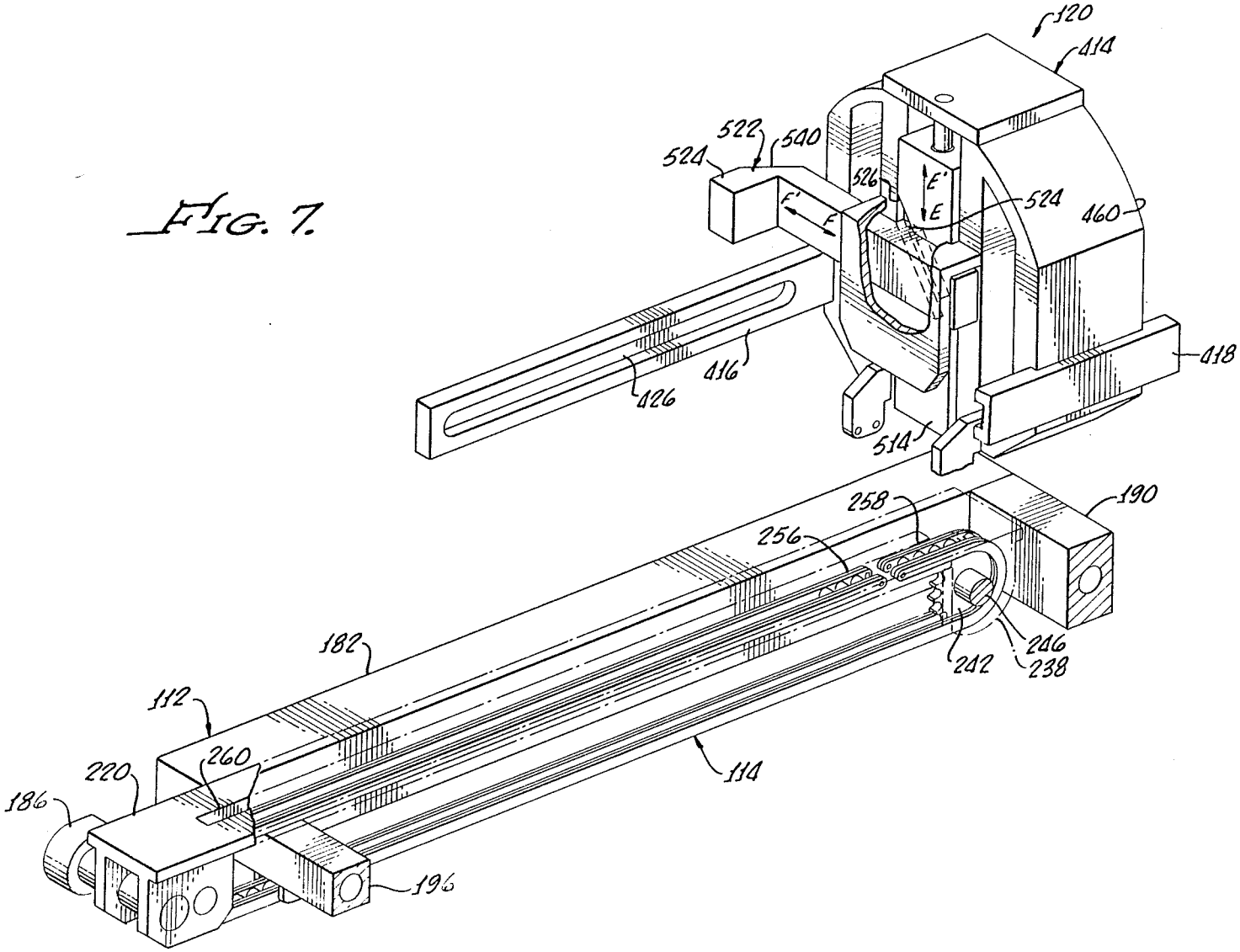
FIG. 7 is a partially cut away perspective drawing of the rammer assembly showing features thereof.
Figure 9A:
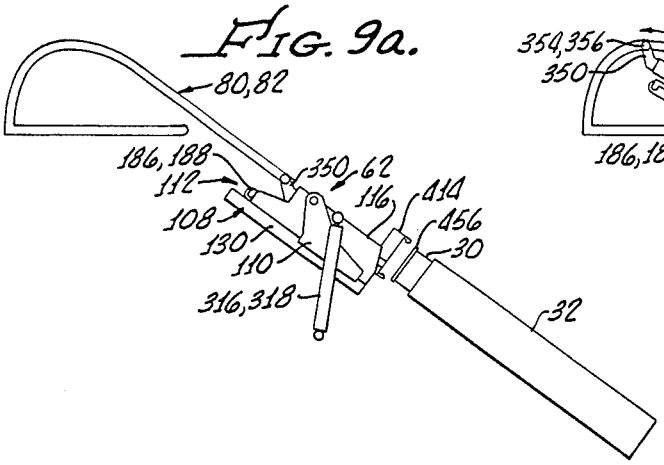
FIG. 9 is a pictorial drawing showing sequential operation of the shell loading apparatus.
Figure 9E:
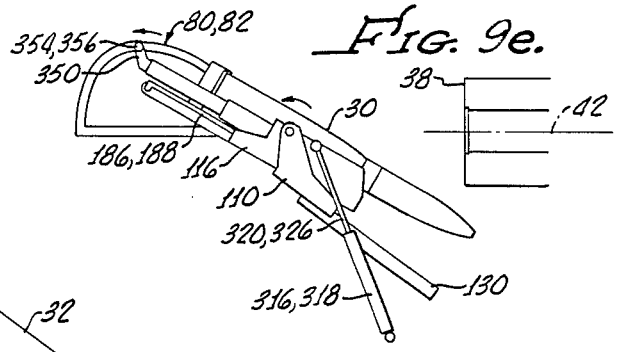
Figure 9B:
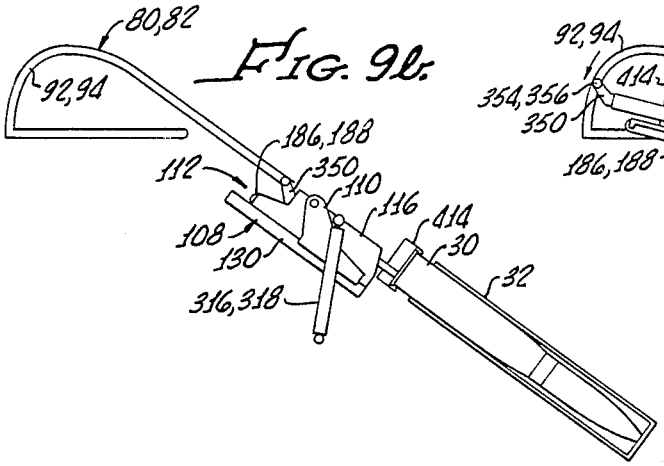
Figure 9F:
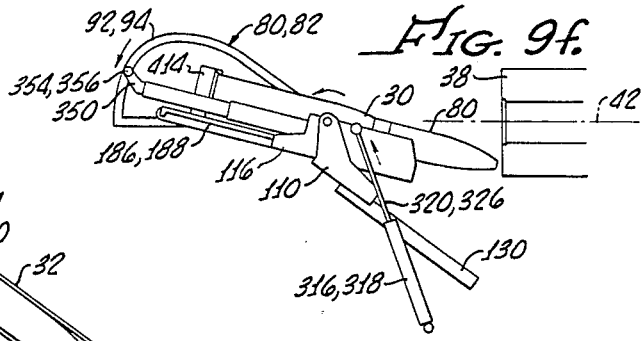
Figure 9C:
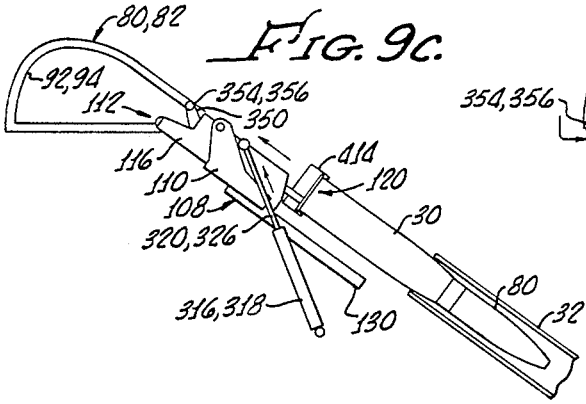
Figure 9G:
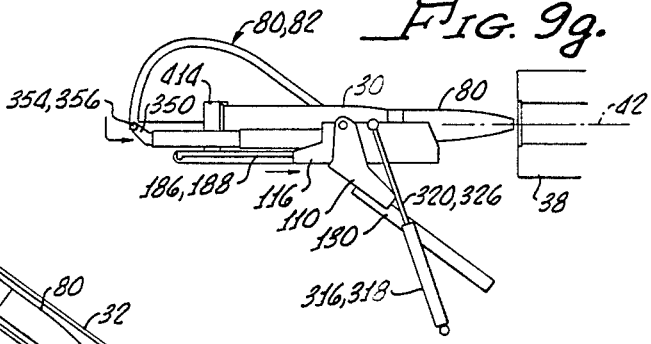
Figure 9D:
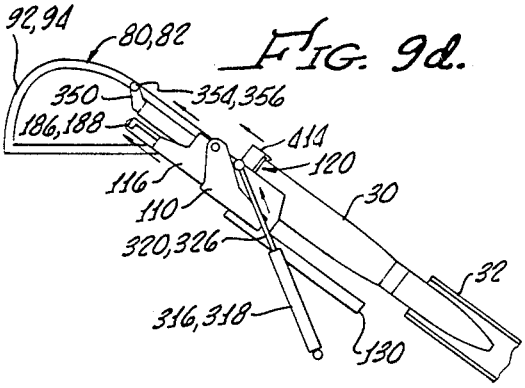
Figure 9H:
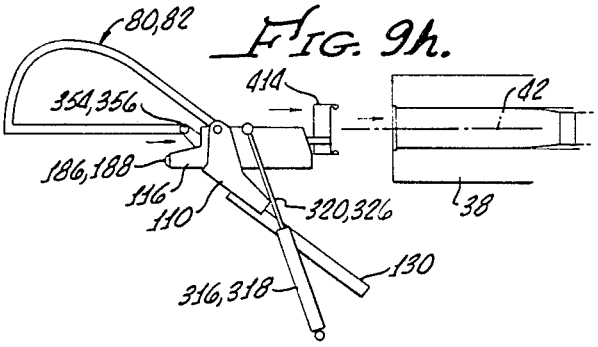

Actuating means 512 (FIGS. 6 and 7) are provided for causing the pivoting open of shell gripping members 446 and 448 to enable the release of a shell 30 held thereby. Included in actuating means 512 is an elongate actuating bar 514 which is slidably mounted to (or through) rammer head 414 rearwardly of gripping members 446 and 448. Actuating bar 514 is mounted parallel to rammer head face 460 and is centered in the plane through barrel bore axis 42 and axis 41 through shell pickup position 32. Formed into a forward face 516 of bar 514 in an upper recess defined by an arcuate camming surface 518 and a lower recess defined by an arcuate camming surface 520.

Actuating bar 514 is positioned relative to upper and lower shell gripping members 446 and 448 such that upper member roller 468 is in rolling engagement with upper camming surface 518 and lower member roller 490 is in rolling engagement with lower camming surface 520. Camming surfaces 518 and 520 are shaped so that when actuating bar 514 is in its lowermost, "normal" position (as shown in FIG. 6), upper and lower gripping members 446 and 448 are in the closed (shell rim gripping) position. However, when actuating bar 516 is moved upwardly, by down-loading shell release toggle means 68 (FIG. 2) (in the direction of arrow E) camming surfaces 518 and 520 cause rollers 468 and 490 to move forwardly, thereby causing upper gripping member 446 to rotate counterclockwise (direction of arrow C') and lower gripping member 448 to rotate clockwise (direction of arrow D'). Thus, when actuating bar 516 is moved upwardly, upper and lower gripping members 446 and 448 are cammed open to release shell rim 456 and thereby release shell 30 held by rammer head 414.

Thereafter, when actuating bar 514 is released, rearward pressure of rollers 468 and 490 on camming surfaces 518 and 520 (caused by spring loaded pins 474 and 494) forces the actuating bar back downwardly (direction of arrow E'), enabling gripping members 446 and 448 to pivot back to their closed, shell gripping position.

Further comprising actuating means 512 is a second, transverse actuating bar 522 (FIG. 7) which is slidingly mounted to (or through) rammer head 414 just rearwardly of above-described actuating bar 514. Abutting, 45° camming surfaces 524 and 526 on actuating bars 514 and 522, respectively, enable transverse sliding movement of second bar 522 (in direction of arrow F) to cause upward movement of actuating bar 514 (direction of arrow E) to thereby cam open shell gripping members 446 and 448. Subsequent release of second actuating bar 522 causes such bar to move back outwardly (direction of arrrow F'), actuating bar 514 to move back downwardly (direction of arrow E') and gripping membrs 446 and 448 to pivot back to the closed, shell rim gripping position. Spring loaded pins 474 and 494 acting on members 446 and 448 cause such return movement of actuating bars 514 and 522, as described above.

An outer end portion 524 of second actuating bar 522 is configured for engagement by portions of shell loading release toggle means 66 when rammer head 414 is moved forwardly into the second, shell loading position. Such engagement causes second actuating bar 522 to be pushed inwardly (direction of arrow F), thereby causing the opening of shell gripping members 446 and 448 and the releasing of a shell 30 held thereby.

Figure 8:
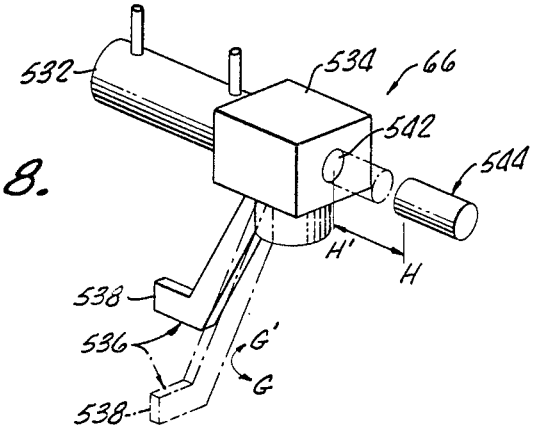
FIG. 8 is a perspective drawing of a shell loading toggle release portion of the automated shell loading apparatus (on sheet 2)

As shown in FIG. 8, shell loading release tripper means 66 comprises a pressurized fluid actuating cylinder 532 operatively connected to a rotary drive box 534 for pivotally moving a tripper lever 536 which is pivotally connected to the drive box. Normally, fluid pressure is applied to one end of cylinder 532 in a manner maintaining tripper bar 536 in the retracted position shown in FIG. 8 in solid lines. Tripper means 66 are bolted to structure to which a cannon 40 is mounted, rearwardly of gun breech 38 and laterally adjacent the rammer head second position. In the normal retracted position, however, tripper lever 536 is out of the path of rammer head 414 and is also out of the path of shells and/or shell casings ejected rearwardly from breech 38.

Application of fluid pressure to the other end of cylinder 532 causes tripper lever 536 to pivot from the retracted position outwardly (direction of arrow G), through about 90° to the deployed position shown in phantom lines. In such a deployed position a lower projecting end portion 538 of lever 536 is located in the path of second actuating bar end region 524, described above; thus, as rammer head 414 closely approached the second, shell loading position, the deployed tripper lever 536 engages a beveled or rampshaped surface 540 (FIG. 7) of actuating bar portion 524. Ramping action of actuating bar surface 540 against lever end portions 538 causes, in response to continued rammer head movement into the second position, second actuating bar 522 to be pushed inwardly (direction of arrow F, FIG. 7) in turn causing actuating bar 514 to slide upwardly (direction of arrow E), thereby causing opening of gripping members 446 and 448 (FIG. 6).

Further comprising tripper means 66 is a pin 542 which is retracted into box 534 when lever 536 is in the retracted position. However, when lever 536 is pivoted (direction of arrow G,) to the deployed position shown in phantom lines (FIG. 8) pin 542 moves axially outwardly (direction of arrow H) towards an associated proximity switch 544, which comprises part of sensor and control means 70. Switch 544 provides an indication (as described below) when lever 536 is in the deployed position. When lever 536 is pivoted back to its retracted position, pin 542 is moved (direction of arrow H') back into box 534. Proximity switch, 544 which may be of the Hall type, is mounted to gun mounting structure, as with screws (not shown) so as to be in a fixed positional relationship with tripper means 66.

Shown in FIG. 5(*b*) is downloading shell release tripper means 68. Comprising such means 68 is a pressurized fluid cylinder 550 an upper end of which is mounted, as by a plurality of screws 552 to an under surface 554 of rammer support guide 132 (reference also FIG. 2). An upwardly projecting pin type piston 556 extends through aperture 140 formed in guide 132. When rammer head 414 is in the first, shell pickup position and pressurized fluid is applied to the "up" end of cylinder 550, pin 556 is caused to move upwardly (direction of arrows I) and project through aperture 194 of rammer cylinder assembly into pushing engagement with a lower end surface 568 of first actuating bar 514 (FIG. 6). Continued upward movement of pin 556 then causes upward movement (direction of arrow E, FIG. 6) of actuating bar 514, thereby causing shell gripping members 546 and 548 to pivot open and release the shell 30 held thereby. In such manner, an unfired shell can be downloaded back into magazine shell pickup position 32 (FIG. 2). After shell 30 is released, fluid pressure is applied to the "down" side of cylinder 550 (FIG. 8), to cause pin 550 to retract (in direction of arrow I').

Figure 3:
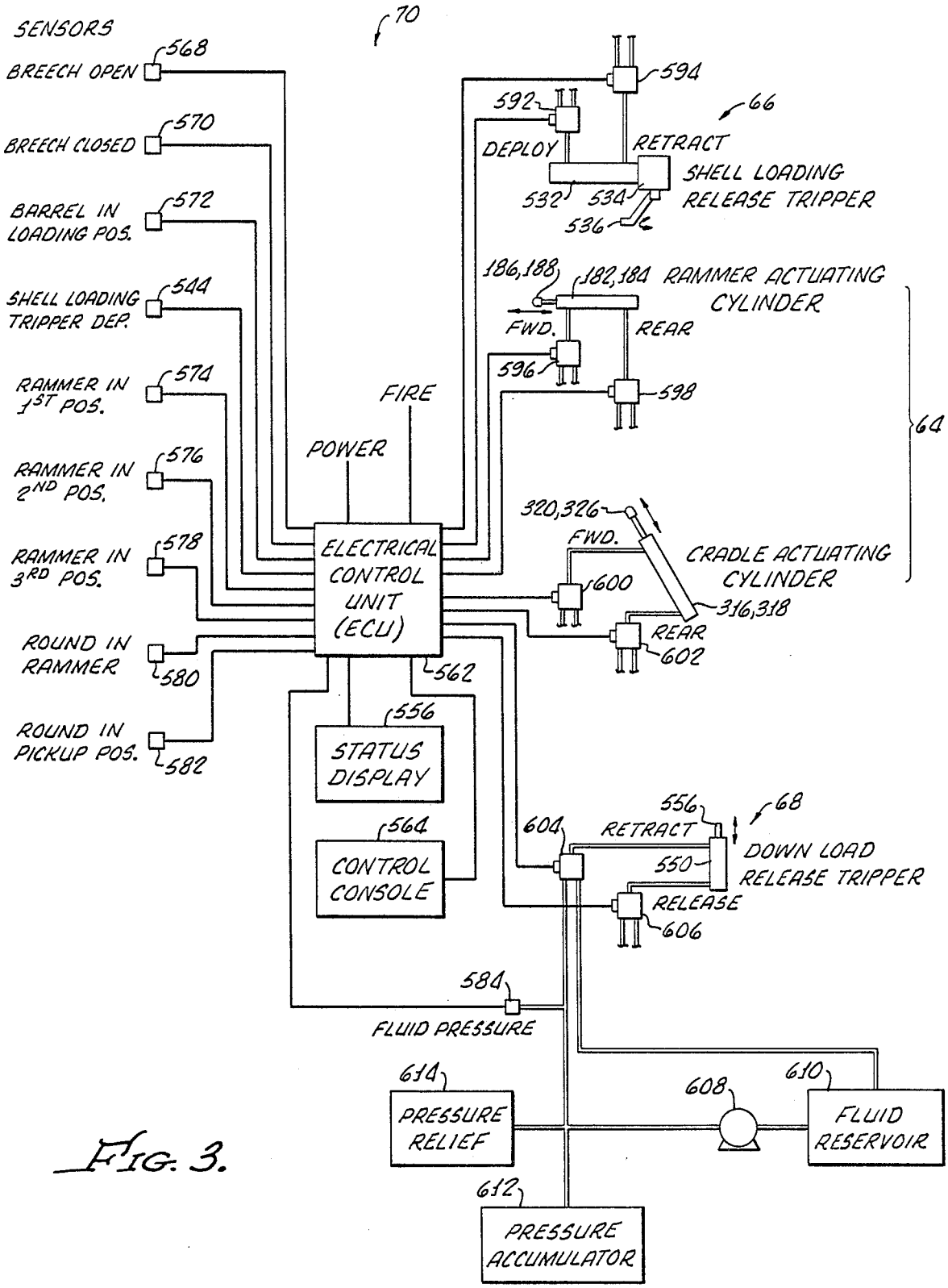
FIG. 3 is a schematic drawing showing sensor and control portions of the automated shell loading apparatus.

Sensor and control means 70, as shown in FIG. 3, comprise generally an electronic control unit (ECU) 562 which is operatively connected to a plurality of electrically operated, pressurized fluid control valves and to which is operatively connected a plurality of weapon system sensors. Electrically connected to ECU 562 is a control console box 564 and a status display box 556. In response to commands, such as "load", "download" or "fire", received from control console 564, ECU 562 checks shstem status, as provided by the various sensors, and in accordance with internal programming associated with the commands, causes operation of the various fluid control valves (and other parts of the system, such as shell firing mechanisms and magazine advancing mechanisms, not shown) in a predetermined sequence required for executing the received command.

General configuration and operation of sensor and control means 70 is similar to that disclosed in U.S. patent application Ser. No. 608,768 filed on May 10, 1984 and titled "Electronically Controlled, Externally Powered Automatic Gun", which is hereby incorporated in its entirety herein.

More specifically, sensor and control means 70 comprise above-described shell loading "tripper deployed" sensor 544 and such additional sensors as "breech open" sensor 568, "breech closed" sensor 570, "barrel in loading position" sensor 572, "rammer in first position" sensor 574, "rammer in second position" sensor 576, "rammer in third position" sensor 578, "round in rammer" sensor 580, "round in pickup position" sensor 582 and "fluid pressure" sensor 584. Function of each such sensor is self-explanatory from its name. However, by way of example, "breech open" sensor 568 provides an electric signal to ECU 562 indicative of when breech 38 is fully open and shells 30 can therefore be loaded into the breech. As a further example, "barrel position" sensor 572 provides an electric signal to ECU 562 indicating when barrel 44 is in the specific barrel elevational position (zero position) and shell loading apparatus 34 is thus positioned to enable the extraction of a shell 30 from magazine 28.

Based on the appropriate weapon system components being in the correct position at the correct time, ECU 562 proceeds with causing execution, in a step-by-step, go-no-go basis, of the command received from command console 564, in the manner described in detail in the above-referenced patent application Ser. No. 608,768.

ECU 562 is, therefore, electrically connected to shell loading release tripper deploy and retract solenoid valves 592 and 594, which control flow of pressurized fluid to cylinder 532; to rammer actuator forward and rearward solenoid valves 596 and 598, respectively, which control flow of pressurized fluid to cylinders 182 and 184; to cradle actuator forward and rearward solenoid valves 600 and 602, respectively, which control flow of pressurized fluid to cylinders 316 and 318; and to download tripper retract (down) and release (up) to solenoid valves 604 and 606, respectively, which control flow of pressurized fluid to cylinder 550.

Pressurized fluid, preferably hydraulic fluid, is provided to soldenoid valves 592, 594, 596, 598, 600, 602, 604, 606 by a pump 608 which is connected to a fluid reservoir 610 (FIG. 3). Connected downstream of pump 608 may be a pressure accumulator 612 and a pressure relief valve or diaphragm 614. ECU 562 may also control other operations such as elevational movement of barrel 40, opening and closing a breech 38 and shell advancing in magazine 28 according to particular gun, breech and magazine configuration. As such ECU 562 may, in fact, comprise portions of an on-board fire control computer (not shown).

Status display 556 may be provided to visually display weapon system status, such as "gun loaded" to gun crew members, and may, as well, be used to display weapon system diagnostic malfunction information.

OPERATION

The operation of automated shell loading apparatus 34 is generally apparent from the above-description of the apparatus. In particular, rammer means 62 are assembled, as shown in FIG. 5, with rammer cradle 110 slidably mounted on rammer support guide 132. Rammer cylinder assembly 112 is then disposed in cradle 110 and carrier assembly 114 is assembled to rammer cylinder assembly 112 with pins 226 and 228 installed in piston apertures 202 and 204, respectively, and with carrier assembly chain segments 256, 258, 262 and 266 connected to rammer cylinder assembly first bracket 200 and to the second bracket corresponding thereto. Rammer frame 116 is installed on top of carrier assembly 114 with the rammer frame pivotally mounted to cradle 110 by bolts 308 through apertures 162, 304 and 164, 306.

Rammer bridge and slide assembly 118 is installed in rammer frame 116 by keys 395 mounted between rammer frame sides 280 and 282 and slide assembly members 364 and 366. Rammer head assembly 120 is mounted to rammer frame and slide assembly 118 by slidable connecting rammer head rails 416 and 418 between slide members 374, 384 and 382, 386, with cam follower rollers 354 and 356 of rammer bridge 350 in cam track grooves 94 and 96, respectively.

Movement of rammer head assembly 120, in particular of rammer head 414, between the static (third) position, the first, shell pickup position and the second, shell loading position is caused by rammer cylinder assembly 112 and by cylinders 316 and 318 connected to rammer frame 116 (by operation of solenoid valves 596, 598 and 600, 602 FIG. 3).

As depicted in FIG. 9(*a*), pistons 186 and 188 of rammer cylinder assembly cylinders 182 and 184 are maintained in a slightly rearwardly extended position to maintain rammer head 414 in the third, static position in which the rammer head is rearwardly, for example, about two inches rearwardly, of a shell 30 in position 32 (assuming cannon barrel 44 is in the zero, shell-loading elevational position).

To pickup a shell 30 in pickup position 32 (FIG. 9(*b*)), rammer cylinder assembly pistons 186 and 188 are moved forwardly to the fully retracted position causing rammer head 414 to be moved forwardly and downwardly from the static position to the first, shell pickup position. When rammer head 414 moves into the first position, shell gripping members 446 and 448 snap over rim portion 456 of a shell 30 in pickup position 32, thereby enabling the rammer head to lock onto the shell.

Next, as shown in FIG. 9(*c*), rammer frame pistons 320 and 326 are extended to slide rammer frame 116, rammer cradle 110, rammer cylinder assembly 112, carrier assembly 114, rammer bridge and slide assembly 118 and rammer head assembly 120 rearwardly and upwardly relative to rammer support plate 130, with cam followers 354, and 356 moving along straight inlet segments of cam tracks grooves 92 and 94. As rammer head 414 is moved rearwardly in this manner, shell 30 starts being extracted from pickup position 32.

Continued extension of rammer frame pistons 320 and 326 (FIG. 9(*d*)) causes continues rearward and upward sliding movement of rammer head 414. At the same time, additional rearward and upward movement of rammer head 414 is provided by rearward extension of rammer cylinder assembly pistons 186 and 188, rammer yoke 350 being pushed rearwardly and upwardly by rammer rails (416 and 418) so that cam followers 354 and 356 are moved along arcuate portions of cam track grooves 92, 94.

As shown in FIG. 9(*e*), continued extension of rammer frame pistons 320 and 326 causes rammer frame 116 to start counterclockwise pivoting thereof relative to rammer cradle 110, while continued extension of rammer cylinder assembly pistons 186 and 188 moves cam followers 354 and 356 over the top of cam track grooves 92 and 94. In such position shell 30 held by rammer head 414 has been entirely extracted from pickup position 32 and is pivoting, with rammer frame 116, towards barrel bore axis 42.

Continued extension of rammer frame pistons 320 and 326 (FIG. 9(*f*)) causes additional pivoting of rammer frame 116 relative to rammer cradle 110 to bring shell 30 held by rammer head 414, into closer angular alignment with barrel bore axis 42, continued extension of rammer cylinder assembly pistons 186 and 188 at the same time causes cam followers 354, 356 to move downwardly along rearward portions of cam track grooves 92 and 94.

In the position depicted in FIG. 9(*g*), continued extension of rammer frame pistons 320 and 326 has caused maximum pivoting of rammer frame 116 relative to rammer cradle 110, in which position, shell 30 held by rammer head 414 is rearwardly aligned with breech 38. Cam followers 354 and 356 are, at this point, at rearward ends of linear portions of cam track grooves 92 and 94.

Rammer cylinder assembly pistons 186 and 188 are then retracted forwardly (FIG. 9(*h*)), causing rammer head 414 and shell 30 held thereby to move forwardly into the second, shell loading position. In such position, nose portions 80 of shell 30 are inserted into breech 38. When rammer head 414 is stopped in the second position (by pistons 186 and 188 being fully retracted), the shell 30 held by the rammer head is released by tripper means 66 (not shown in FIG. 9(*h*)) and forward momentum causes the shell to fully insert itself into breech 38, as shown.

Normally, rammer head 414 is then returned to the third, static position shown in FIG. 9(*a*), by a reversal of the above-described operation. Downloading of a shell 30 from breech 38 into magazine shell pickup position 32 is accomplished a reverse operation of the steps depicted in FIG. 9(*b*)–(*h*).

It is, of course, to be appreciated that extension and retraction of rammer frame pistons 320 and 326 and rammer cylinder assembly pistons 186 and 188 is controlled at all times by sensor and control means 70 as above-described in conjunction with FIG. 3.

Although there has been described above a particular embodiment of automated shell loading apparatus according to the present invention to illustrate the manner in which the invention may be used to advantage, it is to be appreciated that the invention is not limited thereto. Thus any and all variations, modifications and alternative arrangements as may occur to those skilled in the art are to be considered to be within the scope of the invention as defined in the appended claims.

What is claimed is:

1. Automated shell loading apparatus for loading shells from a shell magazine into the breech of an associated gun for firing, said loading apparatus comprising:

(a) a shell rammer having means for releasably gripping the base of a shell;

(b) means for moving said shell rammer between a first, shell extraction position in which, when the gun barrel is in a specific shell loading elevational position, the shell gripping means are positioned to grip the base of a shell located in a magazine shell pickup position and a second, shell releasing position in which the shell rammer is rearwardly aligned with the open breech of the associated gun and forward portions of a shell, the base of which is gripped by said gripping means, are inserted into said open breech, the means for moving the shell rammer causing initial movement of the rammer upwardly and rearwardly from the first position so as to extract from the magazine a shell the base of which is gripped by the shell gripping means; and (c) means responsive to forward movement of the shell rammer into said second position for causing said shell base gripping means to release the shell gripped thereby, whereupon forward momentum of the shell causes the shell to continue moving forwardly into the breech and to become fully chambered therein, the means for moving the shell rammer including a generally "D"-shaped cam track having a linear portion and an arcuate portion, a cam track follower and means for interconnecting the cam track follower with the shell rammer, the means interconnecting the cam track follower with the shell rammer being configured for permitting limited linear movement of the rammer relative to the cam track follower, the means for moving the rammer from the first position to the second position causing the rammer to move from said first position to the limit of travel permitted to the cam track follower, permitted by the interconnecting means without there being caused any substantial movement of the cam track follower, the moving means thereafter causing the cam track follower to move with the rammer along the cam track.

2. Automated shell loading apparatus for loading shells from a shell magazine into the breech of an associated gun for firing, said loading apparatus comprising:

(a) a rammer having means for releasably gripping the base of a shell;

(b) means for causing, when the barrel of the gun is in a specific elevational position, movement of the rammer between a first, shell extraction position in which the shell gripping means engage the base of a shell located in a magazine shell pickup position and a second, shell loading position in which the shell rammer is rearwardly aligned with the open breech of the associated gun and forward portions of a shell, the base of which is gripped by the shell gripping means, are inserted into said open breech, said rammer moving means including first and second cam tracks, means for mounting the cam tracks rearwardly of the gun breech, in a laterally spaced apart relationship, first and second cam track followers and means for connecting the rammer to the cam track followes so as to enable limited linear movement therebetween, the first and second cam tracks being substantially mirror images of one anothr and being symmetrically mounted, by said mounting means, about the barrel bore axis and to opposite sides thereof, each of the cam tracks being generally "D"-shaped, each having a linear portion and an arcuate portion, the mounting means mounting the cam tracks so that said linear cam track portions are parallel to the barrel bore axis and the cam track arcuate portions are directed upwardly in a direction generally orthogonal to the barrel bore axis, cam tracks being formed having straight lead in segments at forward end regions of the arcuate portions, and the means for causing movement of the rammer including a rammer support and guide mounted in fixed relationship relative to said cam tracks, a rammer cradle slidingly mounted to said rammer support and guide for linear movement towards and away from said lead-in segments of the cam track arcuate portions, and a rammer frame pivotally mounted to said rammer cradle, said rammer being slidably mounted within said rammer frame for limited sliding movement axially towards and away from said lead-in segments of the cam track arcuate portion when the cam followers are disposed in said lead-in segments; and (c) means for causing said shell gripping means to release a shell base held thereby when the rammer is moved forwardly by the rammer moving means into the second position, forward momentum of the released shell thereafter causing the shell to move fully into the gun breech.

3. The automated shell loading apparatus as claimed in claim 2 whrein the means for causing movement of the rammer include a first fluid pressure acutating cylinder having one end pivotally connected to the rammer frame and the other end pivotally connected to structure to which the rammer support and guide is mounted, initial extension of said cylinder causing movement of the rammer from the first position to the second position, causing inear movement of the cam track followers along said lead-in segments of the cam track arcuate portions and causing linear movement of the rammer and the rammer cradle towards the cam tracks; said apparatus further including a second fluid pressure actuating cylinder connected between the rammer frame and the cam followers for causing linear sliding movement of the cam followers relative to the rammer frame, the combined operation of said first and second pressurized fluid cylinders then causing said cam followers to move rearwardly along the cam track arcuate portions and then forwardly along the cam track linear portions, thereby causing movement of the rammer to the second position.

4. For a weapon sytem having a gun and vehicle to the exterior of which is mounted a gun, an automated shell loading apparatus for automatically loading shells from a magazine shell pickup position within the vehicle into the breech of the gun when the breech of the gun is empty and is open to receive a shell from the shell loading apparatus, said shell loading apparatus comprising:

(a) first and second, similar "D"-shaped cam tracks and means for symmetrically mounting said cam tracks to structure to which the gun is mounted rearwardly and spaced apart from said breech, the first cam track being mounted to one side of the barrel bore axis and the second cam track being mounted to the other side of the bore axis so that shell casings ejected rearwardly from the breech pass between said cam tracks, the cam tracks being mounted so that linear portions of the tracks are parallel to the bore axis and so that arcuate portions of the cam tracks are directed upwardly relative to the linear portions thereof;

(b) a shell rammer having mounted therein spring loaded shell base gripping means and actuating means operatively connected to the gripping means for enabling the gripping means to be moved so as to release the base of a shell held by the gripping means;

(c) first and second cam followers configured for traveling along respective ones of the cam tracks;

(d) means for interconnecting the cam track followers with the shell rammer, with the cam followers rearwardly of the rammer, in a manner enabling limited movement therebetween in a direction orthogonal to a forward, shell base engaging face of the rammer;

(e) a rammer support and means mounting the support to structure to which the cam tracks are mounted so as to be fixed relative thereto, said rammer support being mounted parallel to forward inlet regions of the cam track arucate portions;

(f) a rammer cradle and means for slidably mounting the cradle in the rammer support for sliding movement towards and away from said forward inlet regions of the cam track arcuate portions, (g) a rammer frame and means for pivotally mounting said frame within said rammer cradle so as to enable the frame to pivot relative to the cradle about a transverse axis orthogonal to the direction of sliding travel of the rammer cradle;

(h) rammer actuating means and mean for mounting said actuating means in said rammer frame;

(i) means for telescopingly mounting the means interconnecting the cam followers and the rammer in the rammer frame on top of the rammer actuating means, so as to enable the cam track followers and the rammer to extend relative to the rammer frame in a direction parallel to the direction of movement of the rammer cradle as the cam followers travel along the cam tracks;

(j) means interconnecting the rammer with the rammer actuating means;

(k) rammer frame moving means connected to the rammer frame for causing movement thereof, and movement of the cradle to which the frame is connected along the rammer support and for causing pivotal movement of the rammer frame relative to the cradle as the cam followers travel along the cam tracks;

said rammer actuating means and said rammer frame means being configured, in combination with configuration of the cam tracks, for causing movement of the rammer between a first position in which the shell base gripping means engage the base of a shell in a magazine shell pickup position and a second position in which the rammer is rearwardly of the open gun breech and forward portions of the shell are received within the breech; and (l) releasing means having a toggle member configured for causing operation of the actuating means connected to the rammer shell base gripping means so as to cause the release of a shell held by the gripping means, said releasing means being mounted to mounting structure of the gun rearwardly of the breech and including means for moving the toggle member between a retracted position and an extended position in which the toggle member engages said actuating means when the rammer is moved to said second position, forward momentum of the released shell causing the shell to be fully inserted into the gun breech.

5. Automated shell loading apparatus for loading shells from a shell magazine into the breech of an associated gun for firing, said loading apparatus comprising:

(a) a shell rammer having means for releasably gripping the base of a shell;

(b) means for moving said shell rammer between a first, shell extraction position in which, when the gun barrel is in a specific shell loading elevational position, the shell gripping means are positioned to grip the base of a shell located in a magazine shell pickup position and a second, shell releasing position in which the shell rammer is rearwardly aligned with the open breech of the associated gun and forward portions of a shell, the base of which is gripped by said gripping means, are inserted into said open breech; the shell gripping means comprising a pair of shell base gripping jaws;

(c) means responsive to forward movement of the shell rammer into said second position for causing said shell base gripping means to release the shell gripped thereby, whereupon forward momentum of the shell causes the shell to continue moving forwardly into the breech and to become fully chambered therein; and (d) releasing means for selectively causing the shell gripping means to release the base of a shell when the rammer is in the first shell pickup position so as to enable the downloading return of a shell to the magazine from the breech, the releasing means including means for causing the opening of said shell base gripping jaws, the means for causing the opening of the shell base gripping jaws including a pressurized fluid operator plunger which engages actuating portions of said shell base gripping jaws.

6. Automated shell loading apparatus for loading shells from a shell magazine into the breech of an associated gun for firing, said loading apparatus comprising:

(a) a rammer having means for releasably gripping the base of a shell, the shell base gripping means comprising a pair of shell base gripping jaws;

(b) means for causing, when the barrel of the gun is in a specific elevational position, movement of the rammer between a first, shell extraction position, in which the shell gripping means engage the base of a shell located in a magazine shell pickup position and a second, shell loading position in which the shell rammer is rearwardly aligned with the open breech of the associated gun and forward portions of a shell, the base of which is gripped by the shell gripping means, are inserted into said open breech, said rammer moving means including first and second cam tracks, means for mounting the cam tracks rearwardly of the gun breech, in a laterally spaced apart relationship, first and second cam track followers and means for connecting the rammer to the cam track followers so as to enable limited linear movement therebetween;

(c) means for causing said shell gripping means to release a shell base held thereby when the rammer is moved forwardly by the rammer moving means into the second position, forward momentum of the released shell thereafter causing the shell to move fully into the gun breech; and (d) releasing means for selectively causing the shell gripping means to release the base of a shell when the rammer is in the first shell pickup position so as to enable the downloading return of a shell to the magazine from the breech, the releasing means including means for causing the opening of said shell base gripping jaws, the means for causing the opening of the shell base gripping jaws including a pressurized fluid operated plunger which engages actuating portions of said shell base gripping jaws.

7. An automated shell loading apparatus for loading shells from a shell magazine into the breech of an associated gun for firing, said loading means comprising:

(a) a shell rammer having means at a forward end thereof for releasably gripping the base of a shell; the shell base gripping means comprising a pair of shell base gripping jaws;

(b) a substantially closed loop cam track and means for mounting the cam track to a gun mounting structure rearwardly of the associated gun;

(c) a cam follower and means for connecting the cam follower to the shell rammer;

(d) means for causing movement of the cam follower along and around the cam track, said cam track being shaped so as to cause, when the barrel of the gun is in a preselected elevational position and in response to movement of the cam follower therearound in one direction the rammer to move from a first position adjacent to said shell magazine wherein a shell may be pickup up from the magazine by the rammer to a second shell loading position rearwardly of the barrel of said gun forward portions of a shell griped by the gripping means being inserted into the open breech of the barrel when the rammer is in said second position, movement of the cam follower around the cam track in the opposite direction causing movement of the shell rammer from the second position back to the first position; and (e) releasing means for selectively causing the shell gripping means to release the base of a shell when the rammer is in the first shell pickup position so as to enable the downloading return of a shell to the magazine from the breech, the releasing means including means for causing the opening of said shell base gripping jaws, the means for causing the opening of the shell base gipping jaws include a pressurized fluid operted plunger which engages actuating portions of said shell base gripping jaws.

8. Automated shell loading apparatus for loading shells from a shell magazine into the breech of an associated gun for firing, said loading apparatus comprising:

(a) a shell rammer having means for releasably gripping the base of a shell;

(b) means for moving said shell rammer between a first, shell extraction position in which, when the gun barrel is in a specific shell loading elevational position, the shell gripping means are positioned to grip the base of a shell located in a magazine shell pickup position and a second, shell releasing position in which the shell rammer is rearwardly aligned with the open breech of the associated gun and forward portions of a shell, the base of which is gripped by said gripping means, are inserted into said open breech; and (c) shell releasing means responsive to forward movement of the shell rammer into said second position for causing said shell base gripping means to release the shell gripped thereby, whereupon forward momentum of the shell causes the shell to continue moving forwardly into the breech and to become fully chambered therein;

(d) said shell releasing means including means operatively connected to said shell gripping means and mounted to the shell rammer, tripping means fixed to structure to which the gun is mounted, and include deploying means operatively connected to the tripping means for selectively causing the tripping means to pivot between a first, deployed position in which the tripping means is engaged by said actuating means so as to cause releasing of the shell gripping means when the rammer is moved forwardly into the second position for loading a shell into the gun breech and a second, retracted position in which the tripping means is out of the way of shells and shell casings being ejected rearwardly from said gun breech.

9. Automated shell loading apparatus for loading shells from a shell magazine into the breech of an associated gun for firing, said loading apparatus comprising:

(a) a rammer having means for releasably gripping the base of a shell;

(b) means for causing, when the barrel of the gun is in a specific elevational position, movement of the rammer between a first, shell extraction position, in which the shell located in a magazine shell pickup position and a second, shell loading position in which the shell rammer is rearwardly aligned with the open breech of the associated gun and forward portions of a shell, the base of which is gripped by the shell gripping means, are inserted into said open breech;

said rammer moving means including first and second cam tracks, means for mounting the cam tracks rearwardly of the gun breech, in a laterally spaced apart relationship, first and second cam track followers and means for connecting the rammer to the cam track followers so as to enable limited linear movement therebetween; and (c) shell releasing means for causing said shell gripping means to rlease a shell base held thereby when the rammer is moved forwardly by the rammer moving means into the second position, forward momentum of the released shell thereafter causing the shell to move fully into the gun breech;

said shell releasing means including means operatively connected to said shell gripping means and mounted to the shell rammer, tripping means fixed to structure to which the gun is mounted deploying means operatively connected to the tripping means for selectively causing the tripping means to pivot between a first, deployed position in which the tripping means is engaged by said actuating means so as to cause releasing of the shell gripping means when the rammer is moved forwardly into the second position for loading a shell into the gun breech and a second, retracted position in which the tripping means is out of the way of shells and shell casings being ejected rearwardly from said gun breech.

10. An automated shell loading apparatus for loading shells from a shell magazine into the breech of an associated gun for firing, said loading means comprising:

(a) a shell rammer having means at a forward end thereof for releasably gripping the base of a shell;

(b) a substantially closed loop cam track and means for mounting the cam track to a gun mounting structure rearwardly of the associated gun;

said cam track being generally "D"-shaped, having an arcuate portion and a linear portion, the cam track follower traversing the arcuate portion first in moving the rammer from said first position to said second position and traversing the linear portion first in moving the rammer from said second position to said first position, (c) a cam follower and means for connecting the cam follower to the shell rammer;

(d) means for causing movement of the cam follower along and around the cam track, said cam track being shaped so as to cause, when the barrel of the gun is in a preselected elevational position and in response to movement of the cam follower therearound in one direction the rammer to move from a first position adjacent to said shell magazine by the rammer to a second shell loading position rearwardly of the barrel of said gun forward portions of a shell gripped by the gripping means being inserted into the open breech of the barrel when the rammer is in said second position, movement of the cam follower around the cam track in the opposite direction causing movement of the shell rammer from the second position back to the first position, (e) shell releasing means for causing the release of a shell gripped by the gripping means when the rammer moves forwardly into said second position so that forward momentum of the released shell then causes complete chambering of the shell in the barrel breech, said shell releasing means including means operatively connected to said shell gripping means and mounted to the shell rammer, tripping means fixed to structure to which the gun is mounted, and deploying means operatively connected to the tripping means for selectively causing the tripping means to pivot between a first, deployed position in which the tripping means is engaged by said actuating means so as to cause releasing of the shell gripping means when the rammer is moved forwardly into the second position for loading a shell into the gun breech and a second, retracted position in which the tripping means is out of the way of shells and shell casings being ejected rearwardly from said gun breech.

11. The automated shell loading apparatus as claimed in claims 8, 9, or 10 wherein said tripping means include a pivotally mounted tripper and a pressurized fluid actuating piston connected thereto.

* * * * *